US007137554B2

(12) United States Patent
Bretl et al.

(10) Patent No.: US 7,137,554 B2
(45) Date of Patent: Nov. 21, 2006

(54) CARD MAILER SYSTEM AND METHOD OF PREPARING CARD PACKAGES FOR MAILING

(75) Inventors: Robert J. Bretl, Menominee, MI (US); James G. Bretl, Menominee, MI (US)

(73) Assignee: Dynetics Engineering Corporation, Inc., Lincolnshire, IL (US)

( * ) Notice: Subject to any disclaimer, the term of this patent is extended or adjusted under 35 U.S.C. 154(b) by 78 days.

(21) Appl. No.: 10/385,874

(22) Filed: Mar. 11, 2003

(65) Prior Publication Data

US 2004/0084518 A1 May 6, 2004

Related U.S. Application Data

(63) Continuation-in-part of application No. 10/332,918, filed on Jan. 13, 2003, now abandoned, and a continuation-in-part of application No. 10/257,617, filed on Oct. 15, 2002, now abandoned, and a continuation-in-part of application No. 10/257,616, filed on Oct. 15, 2002, now abandoned, and a continuation-in-part of application No. 10/257,613, filed on Oct. 15, 2002, now Pat. No. 6,902,518.

(60) Provisional application No. 60/104,443, filed on Feb. 23, 2000.

(51) Int. Cl.

| | |
|---|---|
| ***G06K 7/04*** | (2006.01) |
| ***G06K 5/00*** | (2006.01) |
| ***G06K 19/00*** | (2006.01) |
| ***B31F 1/08*** | (2006.01) |
| ***B31F 1/10*** | (2006.01) |

(52) U.S. Cl. ..... 235/445; 235/380; 235/487; 493/424; 493/434

(58) Field of Classification Search ..... 493/424, 493/427, 429, 435, 442, 405, 434; 439/434, 439/413, 418; 235/487, 492, 379, 380, 454
See application file for complete search history.

(56) References Cited

U.S. PATENT DOCUMENTS 4,175,740 A * 11/1979 Klenk ..... 493/435

(Continued)

*Primary Examiner*—Daniel Walsh
(74) *Attorney, Agent, or Firm*—James W. Potthast; Potthast & Associates

(57) ABSTRACT

An automate card package mailer for preparing card packages (60) composed of one or more cards(50) attached to matching carrier forms (33) for mailing has a carrier folding apparatus that is programmable to fold the carriers into different configurations including Z-fold, C-fold, bi-fold and no-fold, has a controller (42) that controls the movement of carriers by different amounts relative to a first folding arm to achieve different first folds, folds the carriers by pushing the fold location on the surface of the carriers into the nib of a first pair of folding pinch rollers with a first pivotally mounted folding arm after guiding the carrier with a slanted guide and an arcuate guide to the desired position beneath the folding arm, makes a second fold with a second pivotally mounted arm that pushes another fold location on a carrier into the nib of a second pair of rotating pinch rollers while a holding member holds a folded section upright in a well. When only one fold is desired the second guide member is moved to and kept at bridging location to guide the folded edge of a carrier to the second pair of folding pinch rollers. When a no-fold configuration is desired, the first folding arm is moved to an upper guide position to help guide the carrier through the first pair of pinch rollers and the second folding arm is moved to and kept in the bridging location to pass the unfolded carrier over the well and to the second pair of folding rollers without folding. Cards are attached to the carriers before folding by dropping them onto a carrier and a support to keep an adhesive pad space from the carrier and then pushing them into the nib of a pair of rollers.

29 Claims, 21 Drawing Sheets

U.S. PATENT DOCUMENTS 4,194,685 A * 3/1980 Hill et al. ..... 235/375
4,403,981 A * 9/1983 Wuthrich ..... 493/419
4,504,259 A * 3/1985 Lindenmuller ..... 493/23
4,677,923 A * 7/1987 Tice ..... 112/104
4,738,440 A * 4/1988 Weir ..... 270/45
4,979,934 A * 12/1990 Tice ..... 493/446
5,000,433 A * 3/1991 Prum et al. ..... 270/49
5,012,073 A * 4/1991 Hewitt et al. ..... 235/375
5,058,873 A * 10/1991 Hewitt et al. ..... 270/52.13
5,405,126 A * 4/1995 Mack ..... 270/6
5,509,886 A * 4/1996 Hill et al. ..... 493/419
5,518,489 A * 5/1996 Willis et al. ..... 493/163
5,701,727 A * 12/1997 Lundstrom et al. ..... 53/569
5,890,344 A * 4/1999 Smith et al. ..... 53/447
5,896,725 A * 4/1999 Lundstrom et al. ..... 53/54
5,980,444 A * 11/1999 Dickhoff ..... 493/433
6,349,829 B1 * 2/2002 Matheis et al. ..... 206/449
6,565,500 B1 * 5/2003 Hailey et al. ..... 493/405
6,592,506 B1 * 7/2003 Lyga ..... 493/424
6,612,974 B1 * 9/2003 Hooper ..... 493/413
6,769,675 B1 * 8/2004 Vijuk ..... 270/39.06
2001/0042584 A1 * 11/2001 Karami et al. ..... 156/66
2003/0207744 A1 * 11/2003 Bretl ..... 493/375
2003/0218329 A1 * 11/2003 Buck ..... 283/56
2004/0089706 A1 * 5/2004 Hill et al. ..... 235/375
2005/0020425 A1 * 1/2005 Kawatsu et al. ..... 493/424

* cited by examiner

CARD MAILER SYSTEM AND METHOD OF PREPARING CARD PACKAGES FOR MAILING

CROSS-REFERENCE TO RELATED APPLICATIONS

This application is a continuation-in-part of and claims under 35USC120 the benefits of U.S. patent application Ser. No. 10/257,616 filed Oct. 15, 2002, now abandoned which claims under 35 U.S.C. 120 the benefit of PCT application Ser. No. PCT/US01/06167 filed Feb. 22, 2001, which claims under 35 U.S.C. 119(e) the benefit of U.S. Provisional Application No. 60/104,443, filed Feb. 23, 2000, and entitled "Card Package Production System and Method"; and a continuation-in-part of and claims the benefit under of U.S. application Ser. No. 10/257,617, filed Oct. 15, 2002 now abandoned which claims the benefit of PCT application PCT/US01/06156 filed Feb. 22, 2001, which, in turn, also claims under 35USC119(e) the benefit of U.S. Provisional Application No. 60/104,443, filed Feb. 23, 2000; and a continuation-in-part of U.S. application Ser. No. 10/257,613, filed Oct. 15, 2002 now U.S. Pat No. 6,902,518 which claims the benefit of PCT application Ser. No. PCT/US01/06159 filed Feb. 22, 2001, which, in turn, claims under 35 U.S.C. 119(e) the benefit of U.S. Provisional Application No. 60/104,443, filed Feb. 23, 2000; and a continuation-in-part of U.S. application Ser. No. 10/332,918, filed Jan. 13, 2003, now abandoned claiming the benefit of PCT application Ser. No. PCT/US01/06126 filed Feb. 22, 2001, which, in turn, claims under 35 U.S.C. 119(e) the benefit of U.S. Provisional Application No. 60/104,443, filed Feb. 23, 2000.

BACKGROUND OF THE INVENTION

1. Field of the Invention

This invention generally relates to card package production and mailing systems and methods to automatically produce card packages composed of cards, such as credit cards, attached to matching carrier forms for mailing.

2. Description of the Prior Art

Card package production systems that produce card packages comprised of cards, such as plastic credit or debit cards, to matching paper carriers that bear printed information including the card owner's name and address in a location for viewing through a window envelope into which the carrier packages may be ultimately inserted, or "stuffed", for mailing to the owner.

Examples of such card package production systems in which the cards are mechanically attached to the carriers are shown in U.S. patent application Ser. No. 09/081,312, filed May 19, 1998, of Bretl et al. and entitled "Card Package Production System with a Multireader Card Track and Method", and in U.S. Pat. No. 5,494,544 issued Feb. 27, 1996 to Hill et al. and entitled "Automatic Verified Embossed Card Package Production Methods"; U.S. Pat. No. 5,541,395 issued Jul. 30, 1996 to Hill et al. and entitled "Card Package Production System with Burster and Code Reader"; U.S. Pat. No. 5,388,815 issued Feb. 14, 1995 to Hill et al. and entitled, "Embossed Card Package Production System with Modular Inserters for Multiple Forms"; U.S. Pat. No. 5,509,886 issued Apr. 23, 1996 to Hill et al. for "Card Package Production System with Modular Carrier Folding Apparatus for Multiple Forms"; and U.S. Pat. No. 5,433,364 issued Jul. 18, 1995 to Hill et al. for "Card Package Production System with Burster and Carrier Verification Apparatus", all assigned to the assignee of the present invention, and all of which together with the references cited therein are hereby incorporated by reference.

In the card package production systems, or card mailers of patent applications noted above of which this application is a continuation-in-part, all of which are hereby incorporated by reference. In those related applications, a mailer is shown in which cards are attached to carrier forms that are then folded twice in what is know as a Z-fold in which the card is attached to a center section with one of two end sections folded over the side of the center section holding the card and the other of the two end sections folded over the side of the center section located opposite the card.

While this known mechanism for performing the folding of the carrier forms operates well for making Z-folds it lacked the flexibility needed in the modern card industry in which some card issuers prefer to have the carriers folded in so-called C-fold, or Bi-fold configuration or to not have the carrier form folded at all.

SUMMARY OF THE INVENTION

The foregoing objectives are achieved in accordance with the card mailer system of the present invention by providing a card mailer and method of automatically creating card packages for mailing in which the card folding apparatus is flexible and has different selectable modes of operation in which the carriers are given different fold configurations.

This objective is achieved in part by providing a card mailing system for producing card packages formed of a card attached to a matching card carrier form having means for attaching cards to matching carriers with a carrier folding apparatus having means for folding carriers at a plurality of folding stations spaced along a carrier path at which folds to the carriers are made, and means for selectively passing the carriers to the plurality of folding locations to selectively fold the carriers into a plurality of different fold configurations. Preferably, the plurality of different fold configurations includes at least two if not all of the configurations of (a) Z-fold, (b) C-fold, (c) bi-fold, and (d) no-fold.

This objective is also achieved by providing a method of folding carriers for use in a card mailing system for producing card packages formed of a card attached to a matching card carrier form having means for attaching cards to matching carriers by performing the steps of folding carriers at a plurality of folding stations spaced along a carrier path at which folds to the carriers are made and selectively passing the carriers to the plurality of folding locations to selectively fold the carriers into a plurality of different fold configurations.

BRIEF DESCRIPTION OF THE DRAWINGS

The foregoing objects and advantageous features of the invention will be described in detail and others will be made apparent from the following detailed description of the preferred embodiment of the of the card mailer and method of automatically preparing card packages for mailing that is given with reference to the several figures of the drawing, in which.

DETAILED DESCRIPTION

Figure 1:
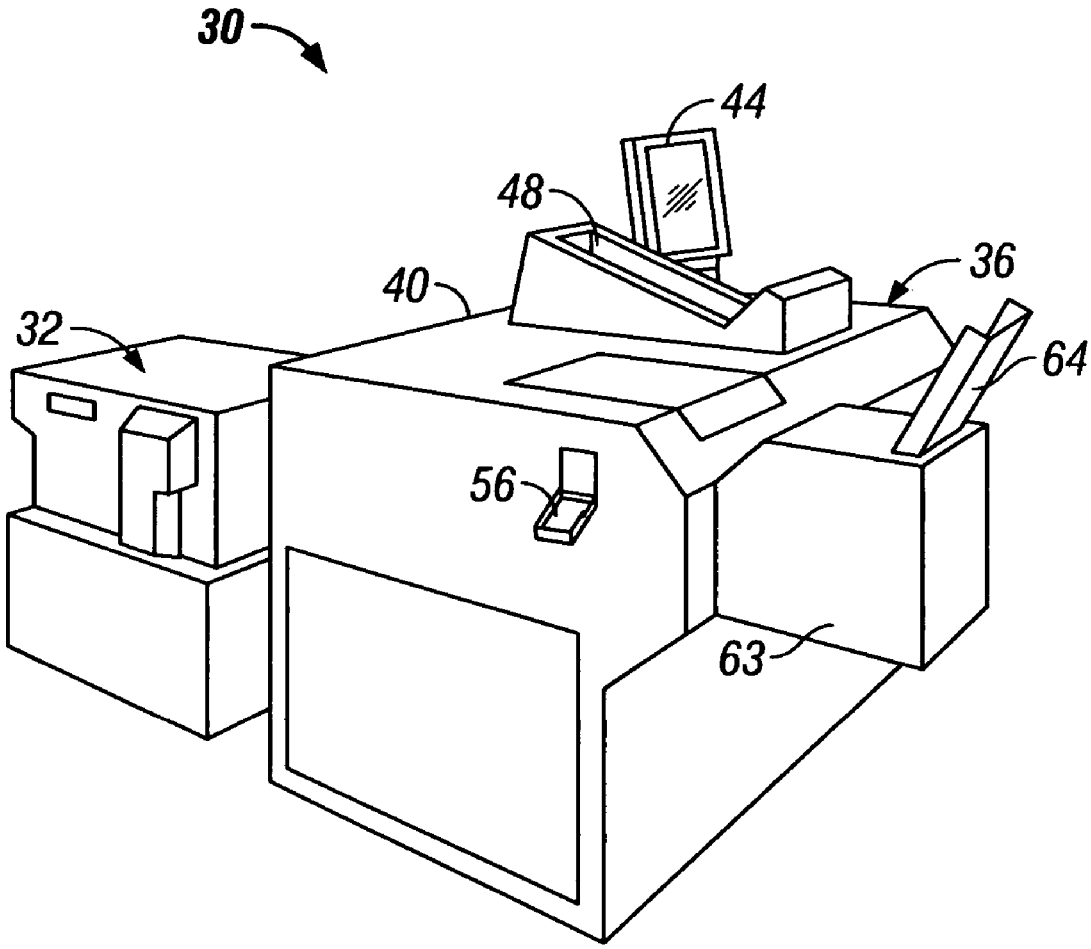
FIG. 1 is a perspective view of the card mailing system of the present invention.
Figure 7:
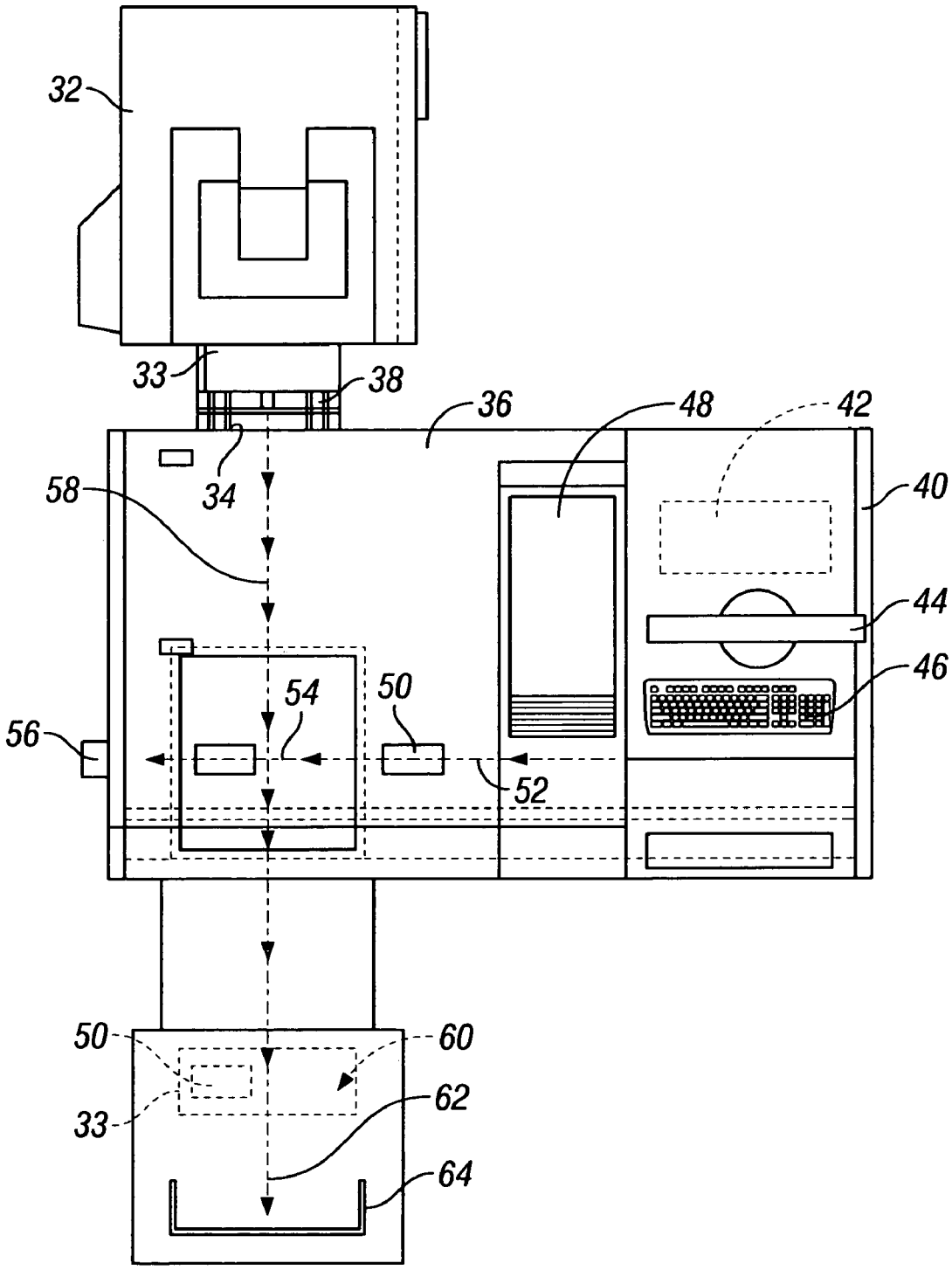
FIG. 7 is plan view of the card mailing system of FIG. 1.

Referring now to FIGS. 1 and 7, a preferred embodiment of the card package mailing system 30 is seen to include a free standing carrier printer 32 that is controlled to produce printed, single sheet carrier forms, on standard letter sized paper. The carrier may print graphics as well as printed information and does include account information including the name and address of the card holder to whom the card package will be mailed and the account number. The single sheet, printed carrier forms 33 are passed to a carrier inlet 34 of a card attachment and carrier folding module 36 via a carrier conveyor 38. The card attachment and carrier folding module 36 has a housing 40 that protectively contains the apparatus for producing the card packages described below including a computer controller 42 that is interfaced with the user via a display screen 44 and a keyboard 46. The details of the computer and associated control system, except for timing relationships as described here, form no part of the invention and is substantially the same as shown and described in the above related patent application, which are hereby incorporated by reference. A stack of cards 50 to be attached are contained in a card stack holder 48 and are transferred one at a time by a card transport mechanism that moves the card along a card path 52 to a card attachment station 54. Any cards 50 that are rejected pass the card attachment station 54 and are not attached to a carrier 33 but instead continue to rejected card outlet 56. The carrier forms, or carriers, 33 are moved by a carrier transport and folding apparatus along a carrier path 58 that is transverse to the card path 52 to the card attachment station 54 at which one or more cards are adhered to the carrier by use of a heat activated adhesive pad. After the card packages 60 are completed, i.e. a printed carrier has had the required number of matching cards attached and the carrier has been folded as desired, the complete card package is passed along a card package path 62 to a card package stacking assembly, or stacker, 63 which stacks completed card packages 60 on a package stack support 64. The details of the stacker and card transport mechanism form no part of the present invention and may be substantially the same as shown and described in the aforementioned related patent applications, except to the extent specified here.

Figure 2:
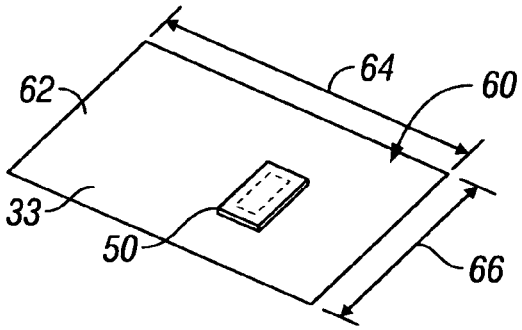
FIG. 2 is a view of a card package composed of a carrier in an unfolded condition with a card, such as a plastic credit card, identification card, etc. adhered or otherwise attached to the carrier form that has matching card holder related information including the name and address of the card holder.

Referring now to FIGS. 2–5, the folding apparatus of the card mailing system 30 is capable of producing carrier form 60 in at least four different configurations. In FIG. 2, the card package 60 is in a no-fold configuration with at least one card attached to the top surface 62 card surface The cards 50 may be attached at different locations along the length 64 by controlling the position of the carrier 33 along the carrier path 58 when the card 50 is dropped. The card may be attached at different selected locations across the width 66 of the carrier 33 by controlling the position of the cards along the card path 52 when they are dropped onto the carrier 33.

Figure 3:
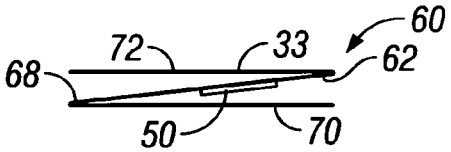
FIG. 3 is a side view of a card package in which the carrier is in a Z-fold configuration with the card mounted to the bottom side of an intermediate section covered on a top side by end section of the folded carrier and protectively covered by another end section on the other side of the intermediate section.

In FIG. 3, a carrier package is shown with the carrier 33 in a Z-fold configuration in which the card 50 is attached to the a middle one-third section 68 with a leading end section 70 folded beneath the middle section and a lagging end section 72 is folded over the top surface of the middle section 68 that is opposite the card surface 62 to which the card 33 is attached.

Figure 4:
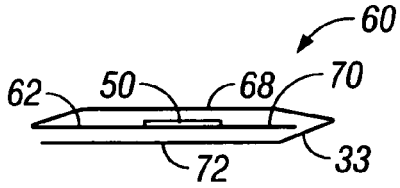
FIG. 4 is a side view of a card package in which the card package is in a C-fold configuration with the card mounted to the top of an intermediate section that is folded beneath an upper section and folded beneath a lower section.

In FIG. 4, the carrier package is shown with the carrier 33 in a C-fold configuration in which the middle section 68 is located on the outside of the package 60 with the leading end section 70 folded and the lagging end section 72 folded to sandwich the leading end section 70 between the middle section 68 and the lagging end section 72.

Figure 5:
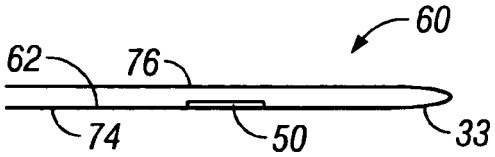
FIG. 5 is a side view of a card package in a bi-fold, or bi-fold configuration configuration, or half fold, configuration with the card attached to one half section with the other half section protectively folded over the card and the one half section.

In FIG. 5, the card package 60 is shown with the carrier 33 in a bi-fold, or half-fold configuration in which the carrier has been folded in half with a leading half section 74 and a lagging half section 76.

Figure 6:
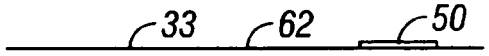
FIG. 6 is a side view of a card package in a no-fold configuration with the card attached to a card carrier by the card mailer without any folds in the carrier for bulk mailing.

In FIG. 6, the carrier package 60 is again shown in a no-fold configuration in which no folds have been made in the carrier 33.

Figure 8:
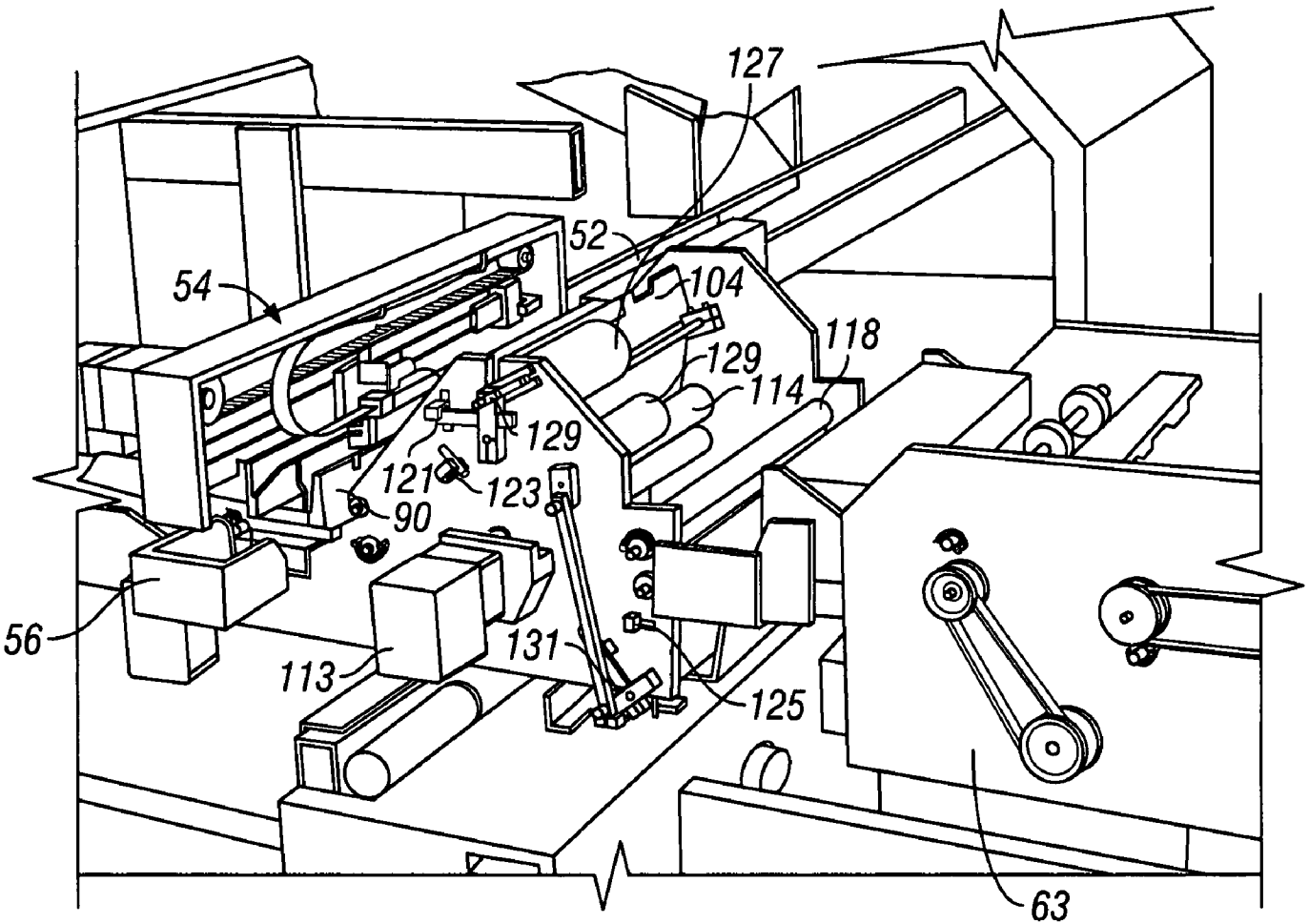
FIG. 8 is a perspective view of the card mailer with the cover removed to view the carrier attaching mechanism and card folding apparatus extending along the card carrier path.
Figure 9:
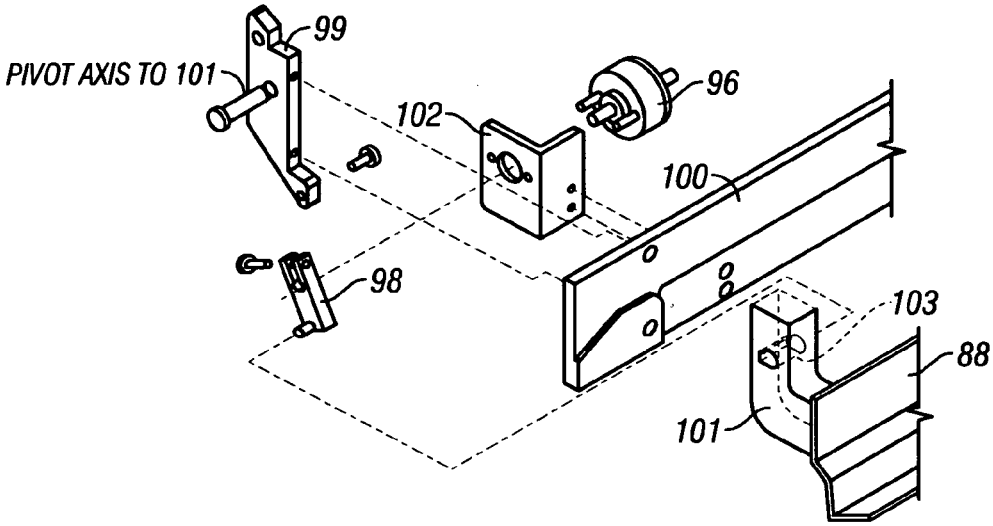
FIG. 9 is a perspective exploded view of a portion of the card attachment station at which one or more cards with adhesive pads are dropped onto the carrier.
Figure 10:
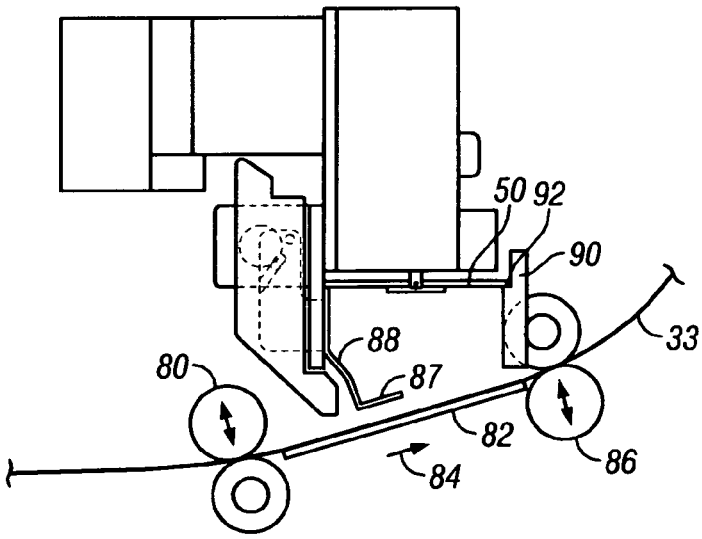
FIG. 10 is a simplified side view of the card attachment station.

Referring now to FIG. 8, a perspective view of the card transport and card attachment station 54 and card path 52 extending between the card hopper 48 are shown in relationship with the various rollers and folding arms used to fold the carrier 33 after a card 50 is attached. A stepper motor 113 drives a shaft that in turn drives through a belt linkage shown in FIG. 27 on the other side of the unit. Photosensors interrupter sensor sense the home 121, 123 and 125 respectively sense the home position of the folding arm 106, the fold position of the folding arm 106 and the fold of the folding arm 116. Another like sensor not seen senses the home position of the folding arm 116. The movement of the folding arm 106 is driven by a D.C. motor 127 and a linkage. Movement of folding arm 116 is driven by another D.C. motor 129 and another linkage assembly 131.

Figure 11:
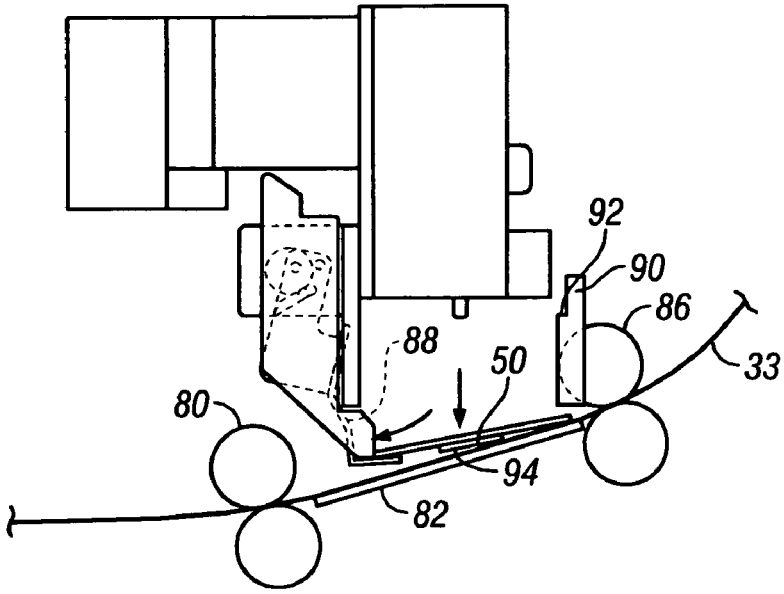
FIG. 11 is another side view of the card attachment station showing a card with adhesive pad being dropped on a carrier that has entered the carrier inlet and is proceeding along the carrier folding path.
Figure 12:
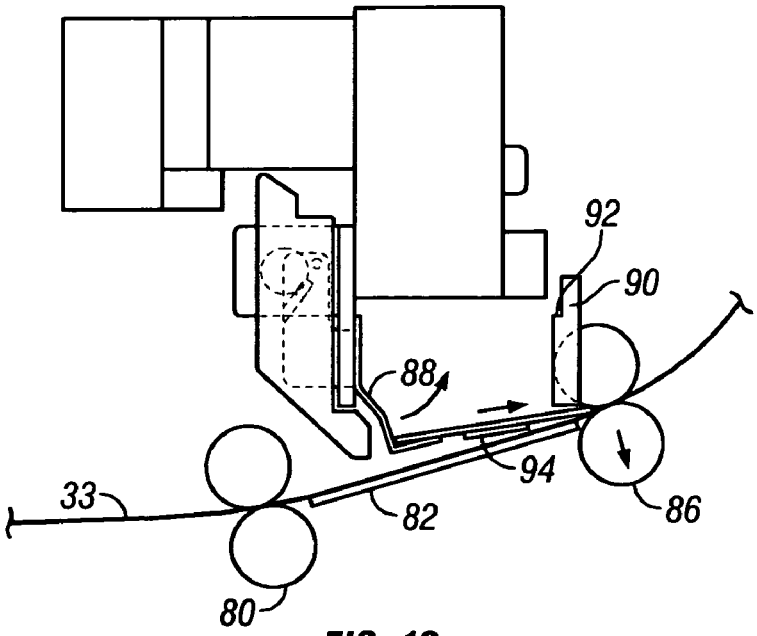
FIG. 12 is another side view of the card attachment station similar to that of FIG. 11 but with a card pusher has pushed the edge of the card into the nib of a pair of pinch rollers to press the card and adhesive pad against the carrier.

Referring to FIGS. 9–12, in accordance with one aspect of the invention, at the card attaching station 54, first pair of drive pinch rollers 80 receives the leading edge of a carrier 33 at the nib and passes and moves the carrier along an upwardly slanted guide 82 in the direction of arrow 84 and into the nib of a second pair of drive pinch rollers 86. Located above the slanted guide 82 is the card drop track at which cards 50 are located in a generally horizontal plane. As best seen in FIG. 11, when the card 50 drops the rearward side of the card falls on an underlying member 87 of a pivotally mounted, L-shaped card feeder arm 88. The card 50 drops toward the card feeder arm 88 and the guide 82 when a movably mounted card support member 90 with a shoulder 92 upon which a forward one of the side edges of the card 50 is moved forwardly from out beneath the card edge. When the card drops, the pivotally mounted card feeder arm 88 is pivoted backwardly from the feed position shown in FIG. 10 when the card is still supported above the carrier, to a retracted catch position in which the underlying member 87 may catch the aft side of the card on the underlying member 87, as shown in FIG. 11. The card feeder arm is then pivoted back to the feed position, as shown in FIG. 12, to push the card into the nib of the carrier drive rollers 86. All the while this operation is being performed, importantly, the adhesive pad 94 which is used to attach the card 50 to the carrier is not allowed to touch the carrier 33 and does not touch the carrier until after it has been precisely located at the correct position at the nib of the carrier drive rollers 86. The card 50 and carrier 33 then passes between the pair of rollers 86, and the adhesive pad 94 is pressed by the rollers 86 against the carrier 33. The card feeder arm 88 is elongate and is capable of feeding multiple cards to the nib of the rollers 86 simultaneously.

The movement of the arm is obtained from a rotary solenoid 96 mounted by a bracket to member 100 that drives a link 98 to rotate. The link has a pin 99 that engages a mating slot 103 in the backside of an L-shaped bracket pivotally mounted L-shaped bracket that is attached to the card pusher 88. Rotary movement of the link 98 results in the desired pushing movement and retracting movement required for the card feeder arm 88.

Figure 13:
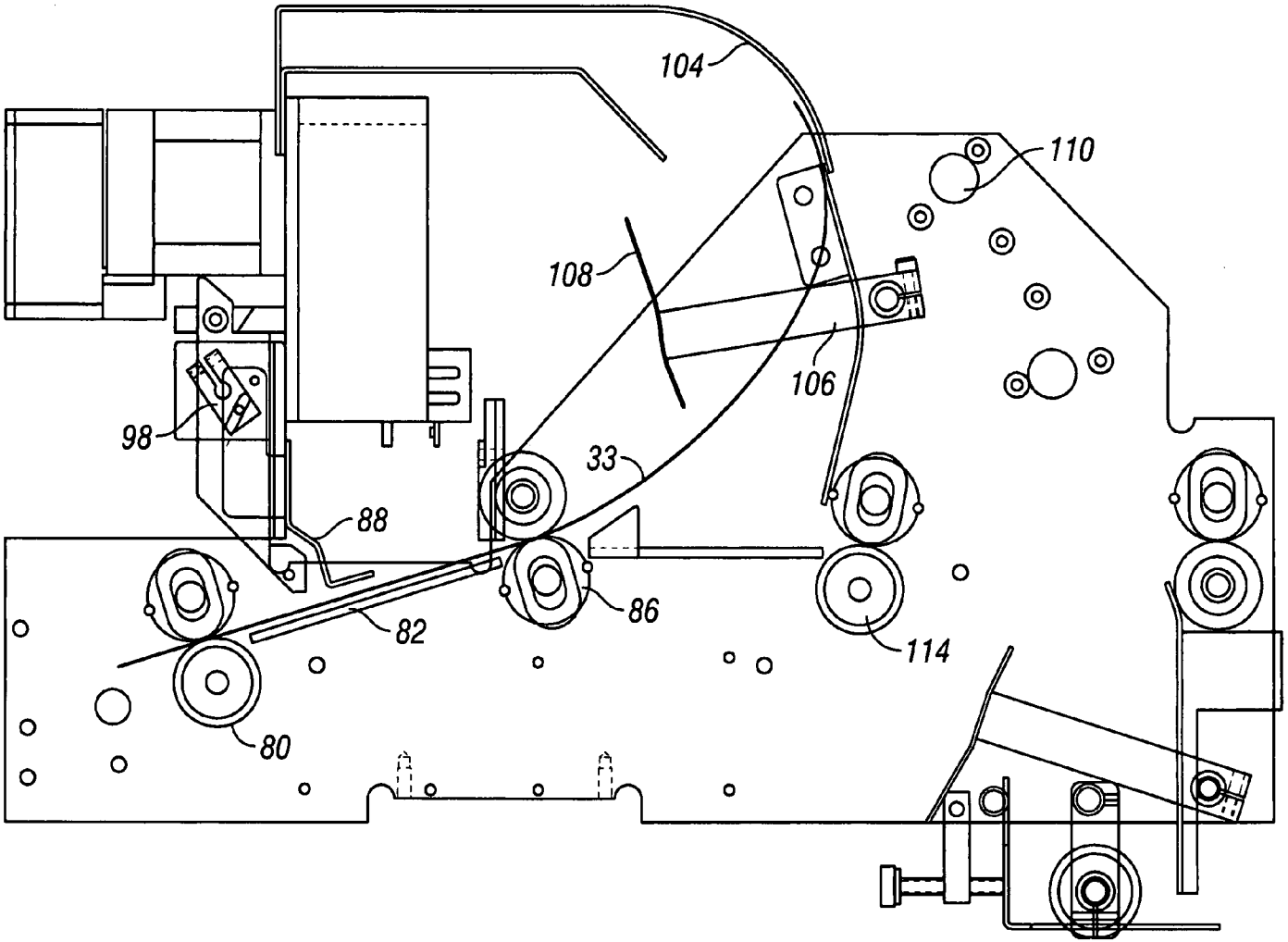
FIG. 13 is a side view of the carrier folding path showing the first step in folding a carrier into a Z-fold configuration.
Figure 14:
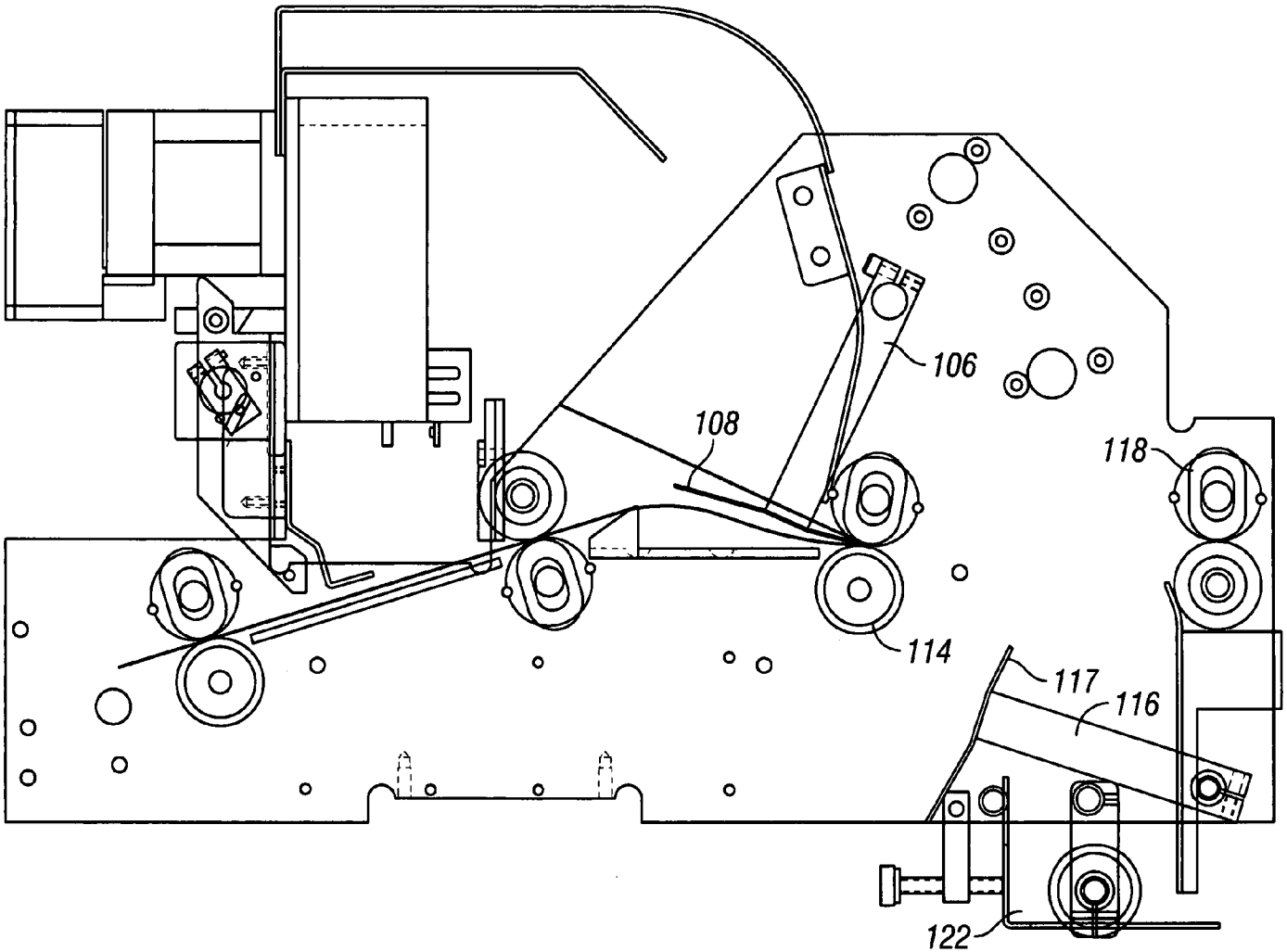
FIG. 14 is another side view of the carrier folding path showing the second step in folding a carrier into a Z-fold configuration.
Figure 15:
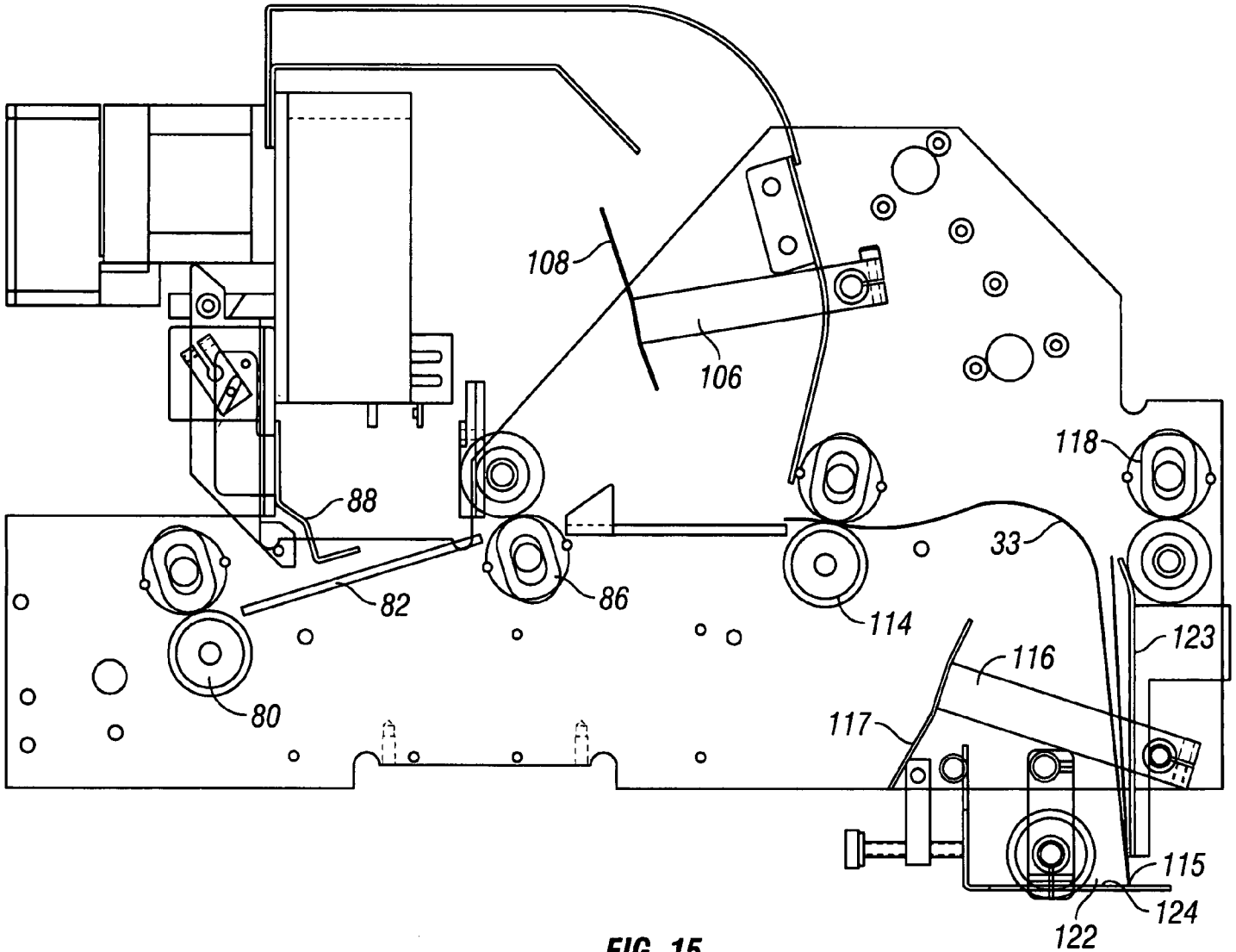
FIG. 15 is another side view of the carrier folding path showing the third step in folding a carrier into a Z-fold configuration.

Referring now to FIGS. 13–17, the carrier folding apparatus of the present invention is seen to include an arcuate carrier guide 104 that curves upwardly and rearward. In order to perform a Z-fold operation, the folding apparatus is proved with a first pivotally mounted folding arm 106 that an elongate plate-like carrier pusher member 108 that spans the width of the carrier 33 and is located between the slanted guide member and the arcuate guide member 104. The folding arm is located at a home position, as shown in FIG. 13, when the carrier is passed beneath and behind it by the guide members 82 and 104. After the carrier has been driven by the rollers 80 and 86 by a preselected distance, approximately one third of the length of the carrier form 33, a motor 110 that is linked to the pivotal folding arm 106 is turned on to pivot the folding arm to the position shown in FIG. 14. As the folding arm moves to this position, the carrier pusher member partly fold and then pushes the fold of the partly folded carrier 33 into the nib of a pair of folding pinch rollers 114. The folding rollers 114 grip the carrier form and pass the partly folded carrier 33 though the rollers to complete the fold and pass the partly folded carrier to a second fold station as shown in FIG. 15.

Figure 16:
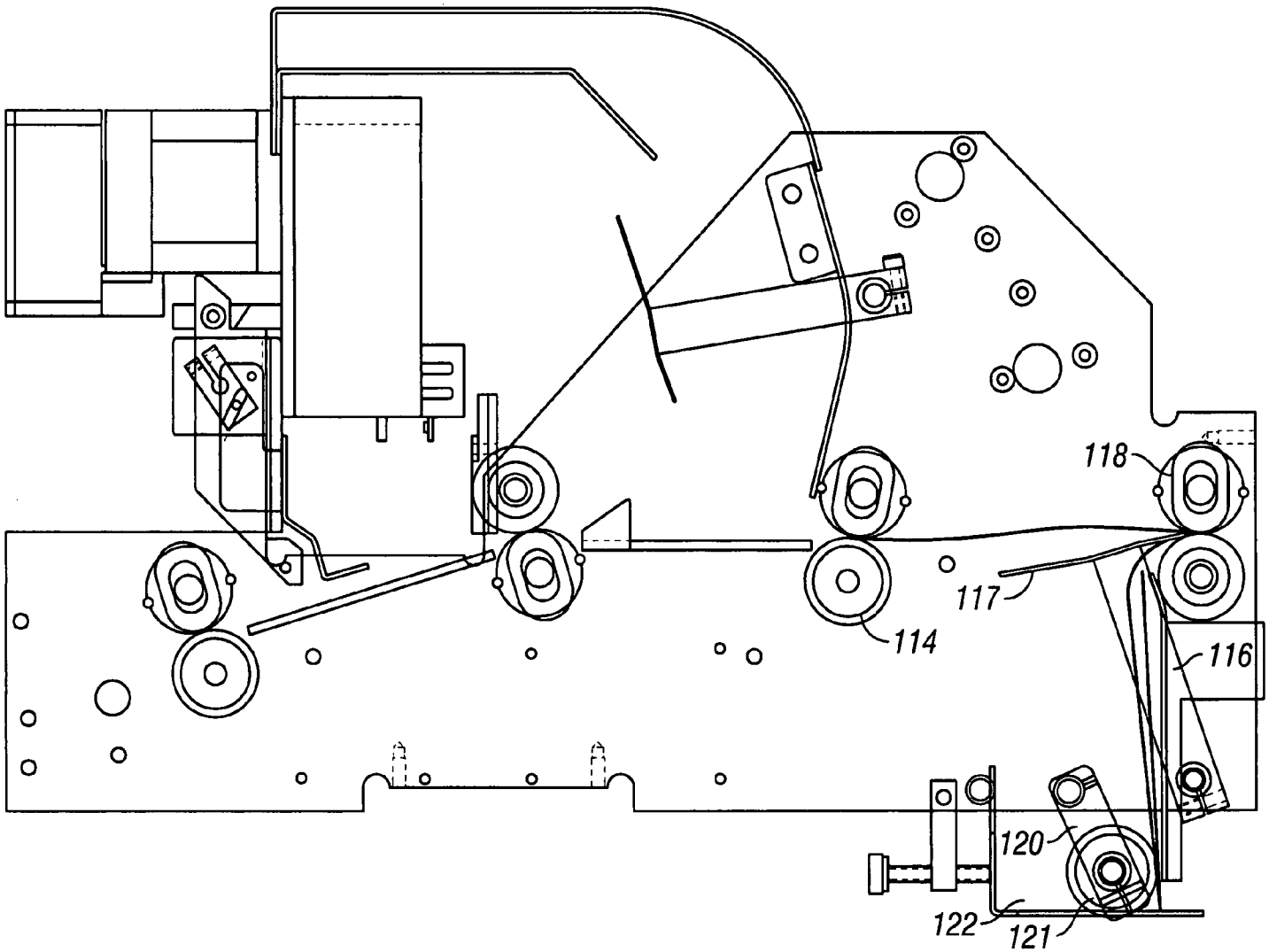
FIG. 16 is another side view of the carrier folding path showing the fourth step in folding a carrier into a Z-fold configuration.
Figure 17:
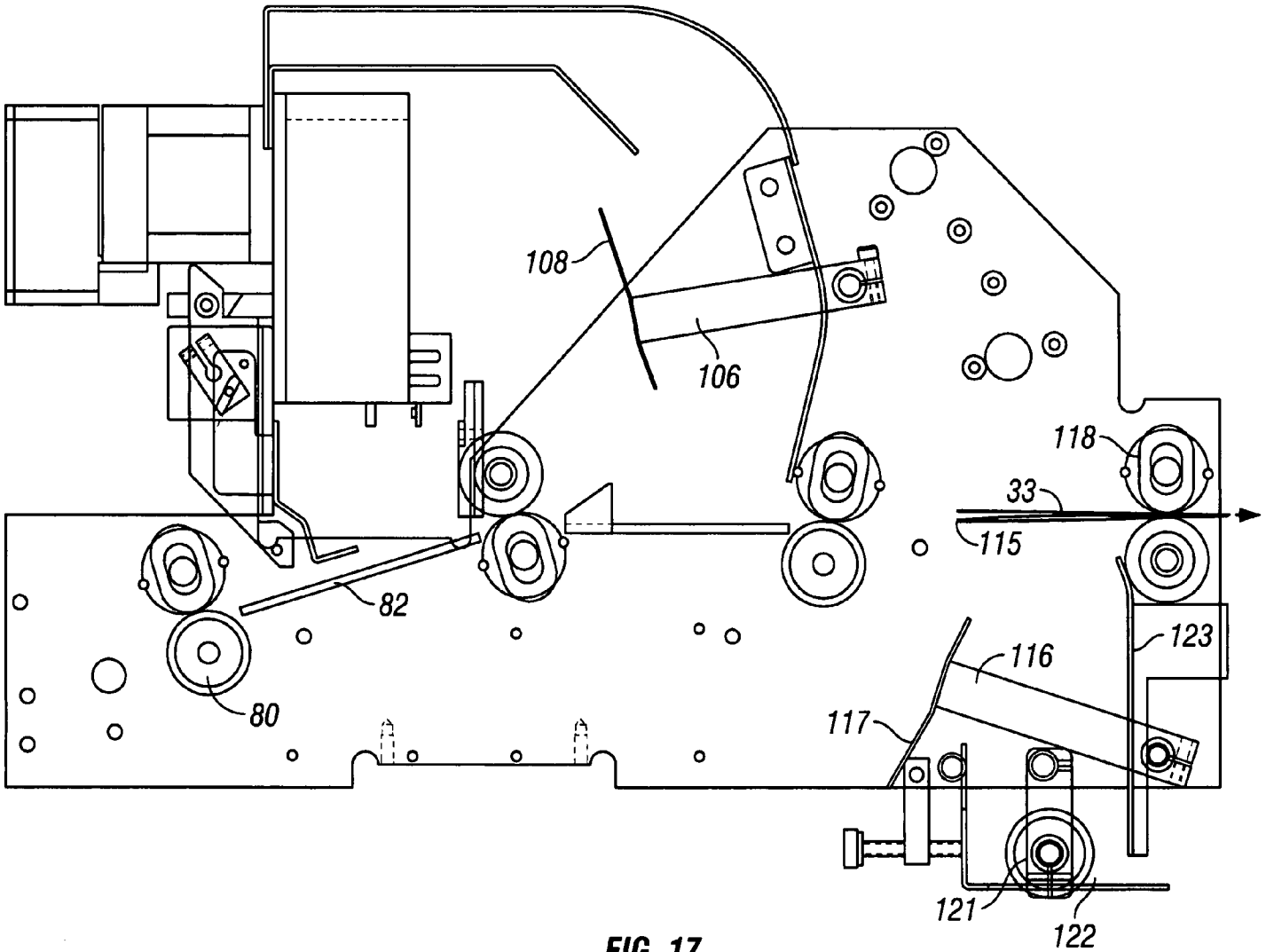
FIG. 17 is another side view of the carrier folding path showing the fifth and final step in folding a carrier into a Z-fold configuration.
Figure 18:
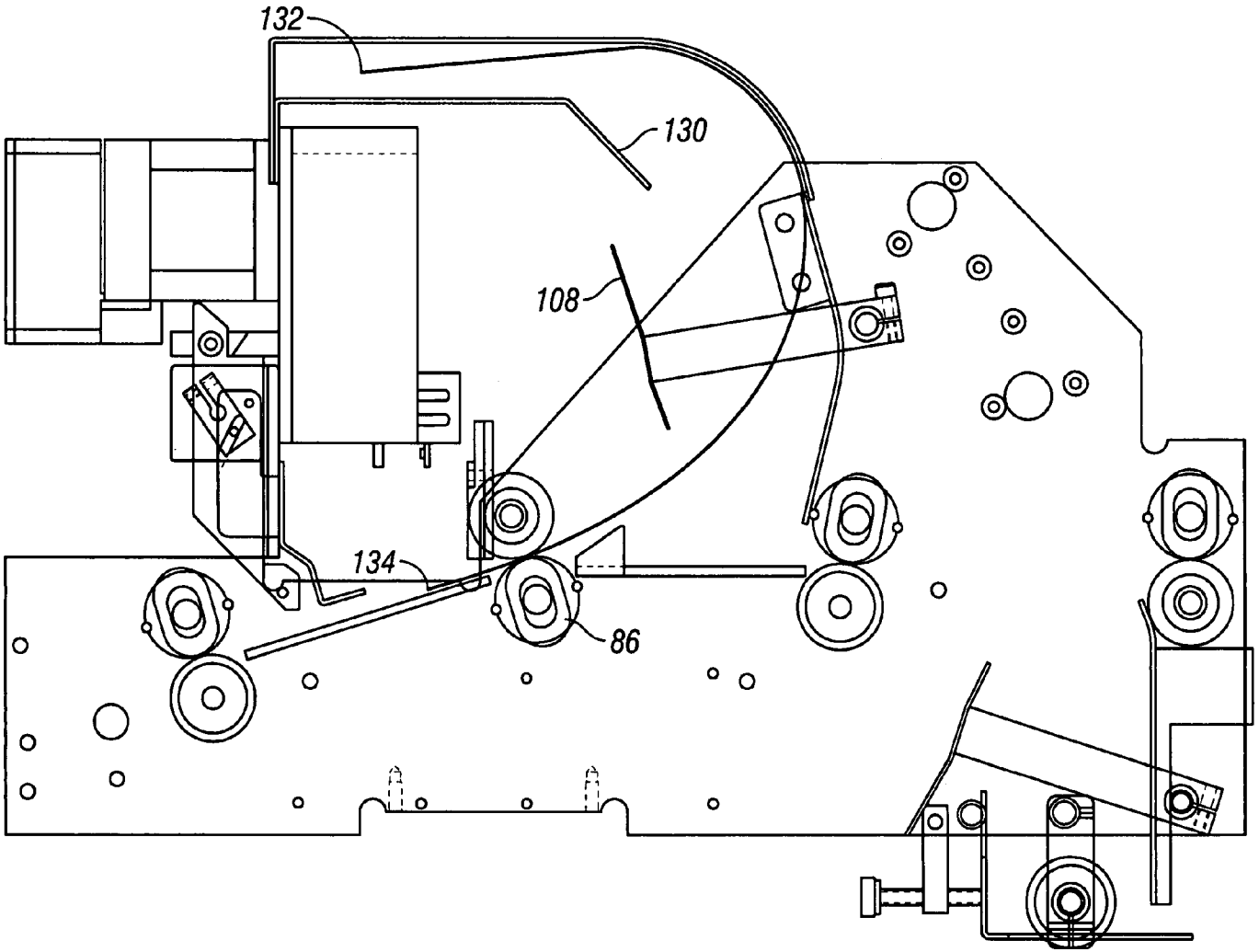
FIG. 18 is another side view of the carrier folding path showing the first step in folding a carrier into a C-fold configuration.
Figure 19:
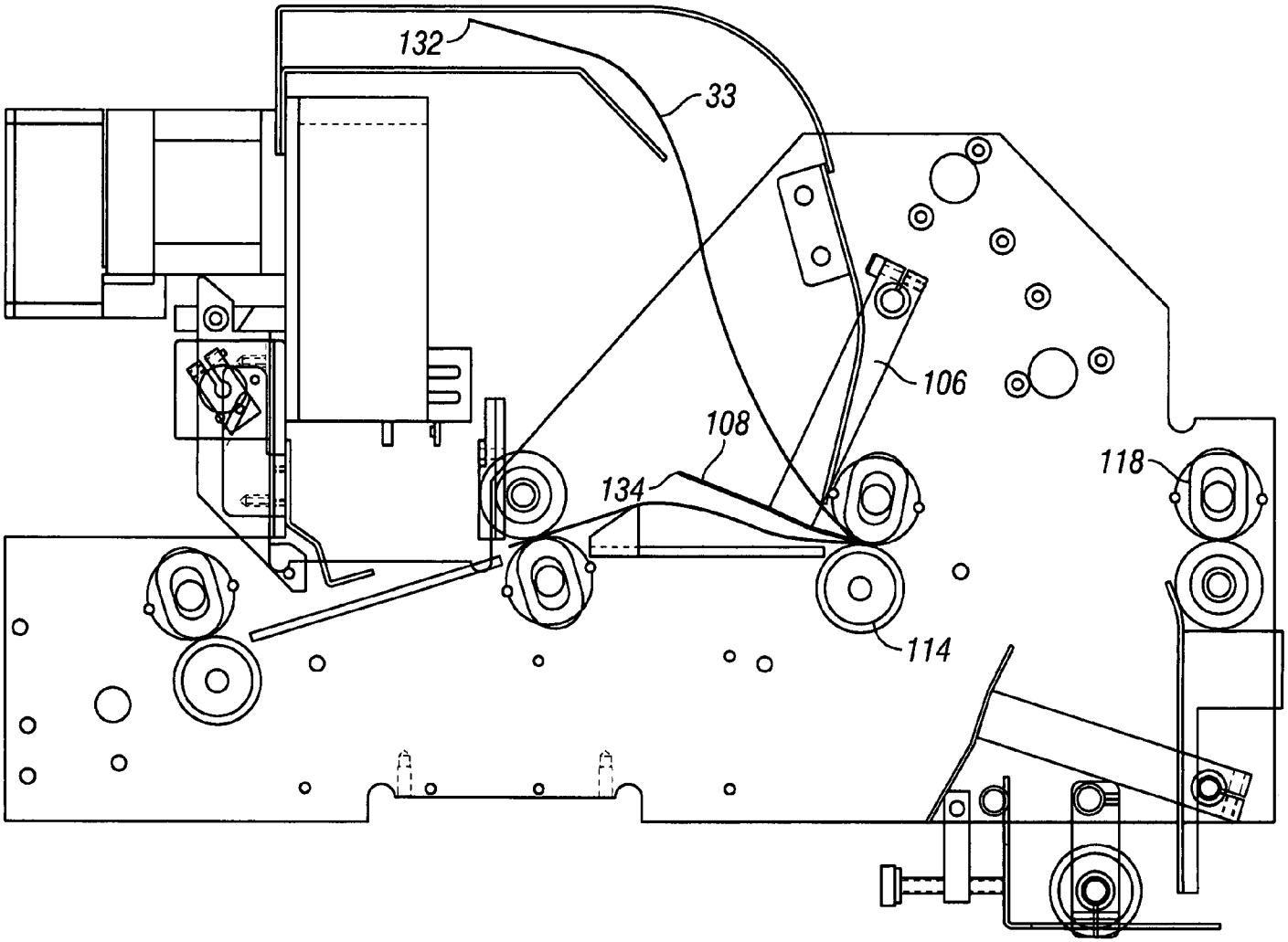
FIG. 19 is another side view of the carrier folding path showing the second step in folding a carrier into a C-fold configuration.
Figure 20:
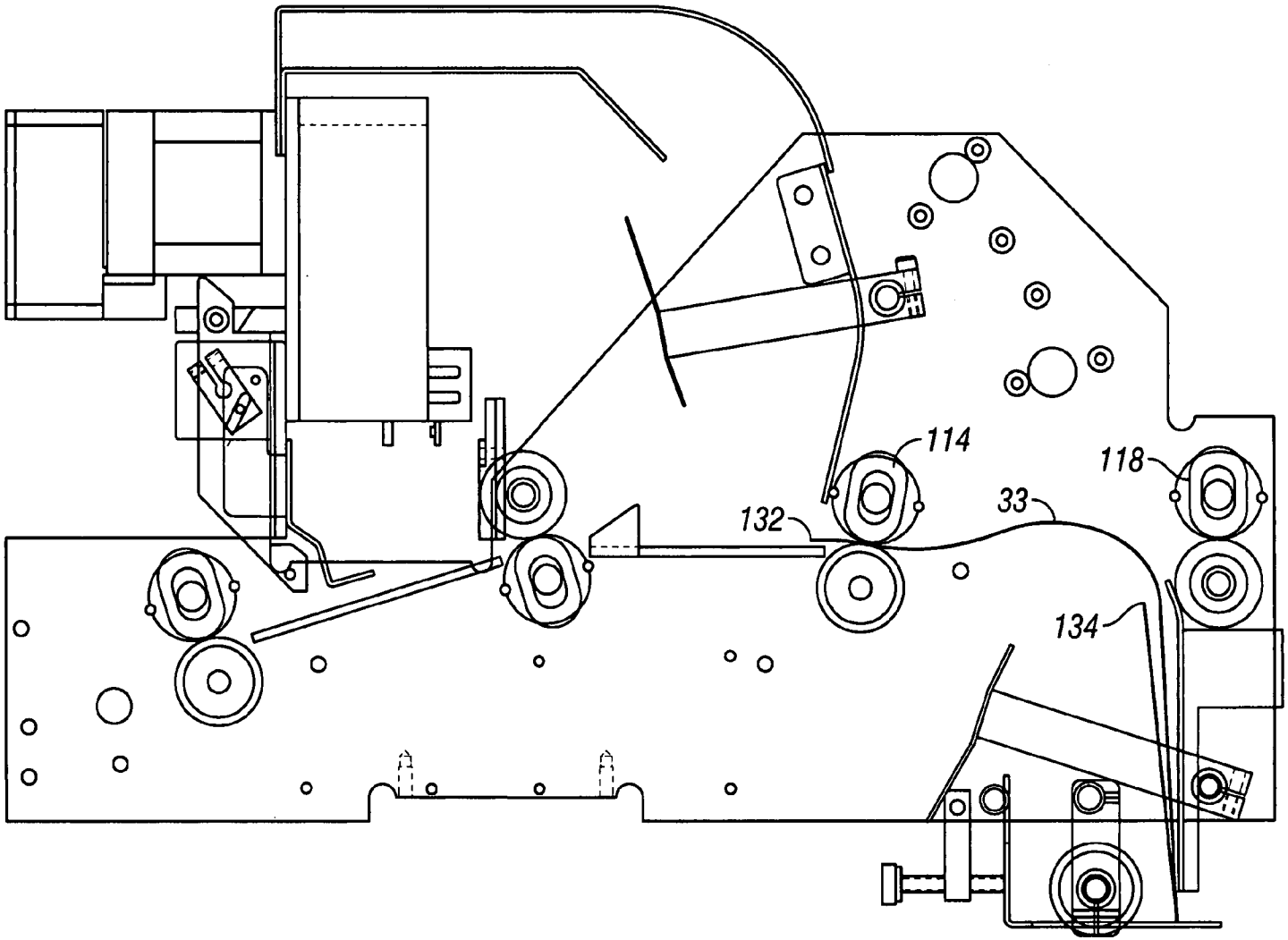
FIG. 20 is another side view of the carrier folding path showing the third step in folding a carrier into a C-fold configuration.
Figure 21:
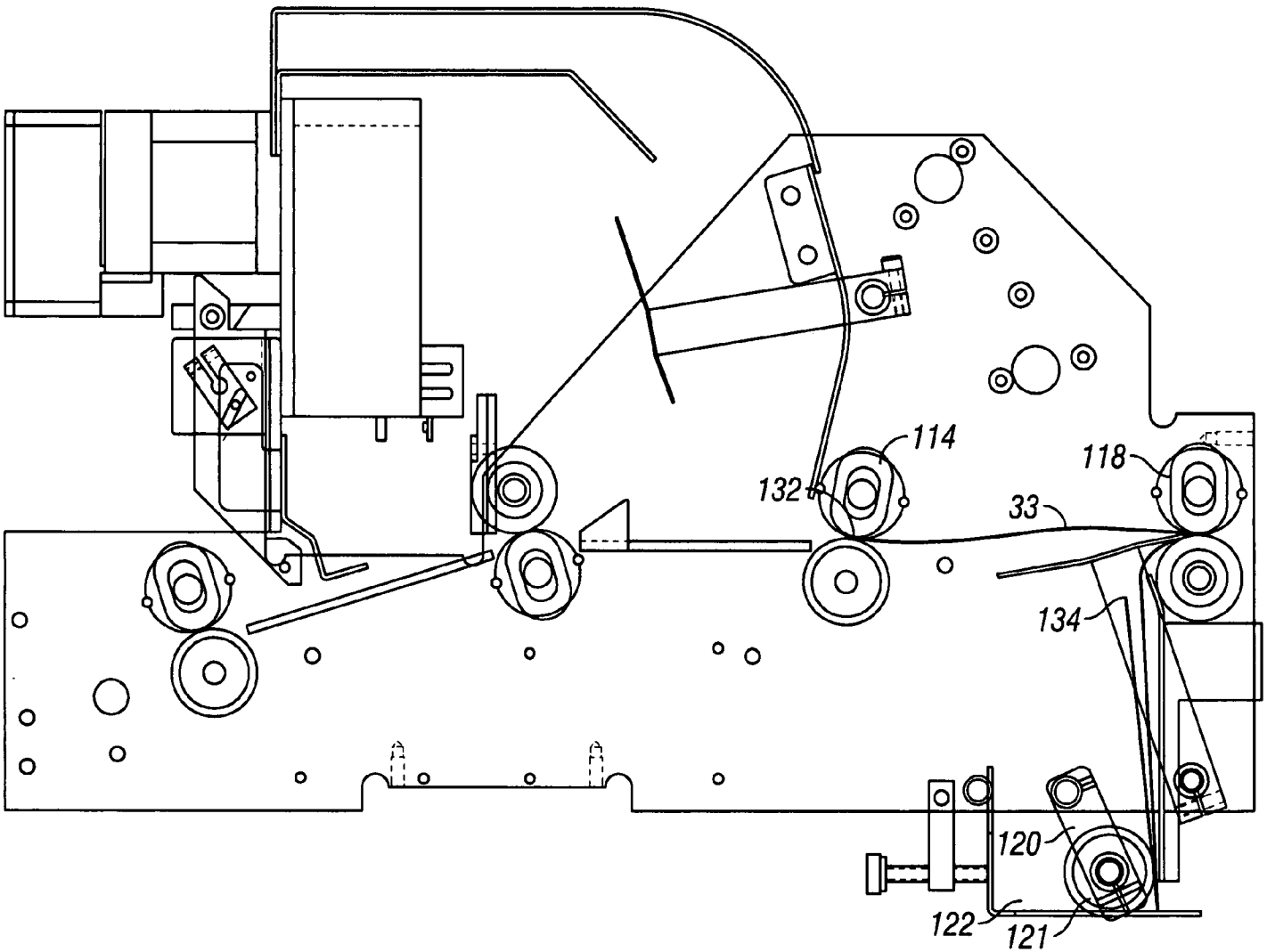
FIG. 21 is another side view of the carrier folding path showing the fourth step in folding a carrier into a C-fold configuration.
Figure 22:
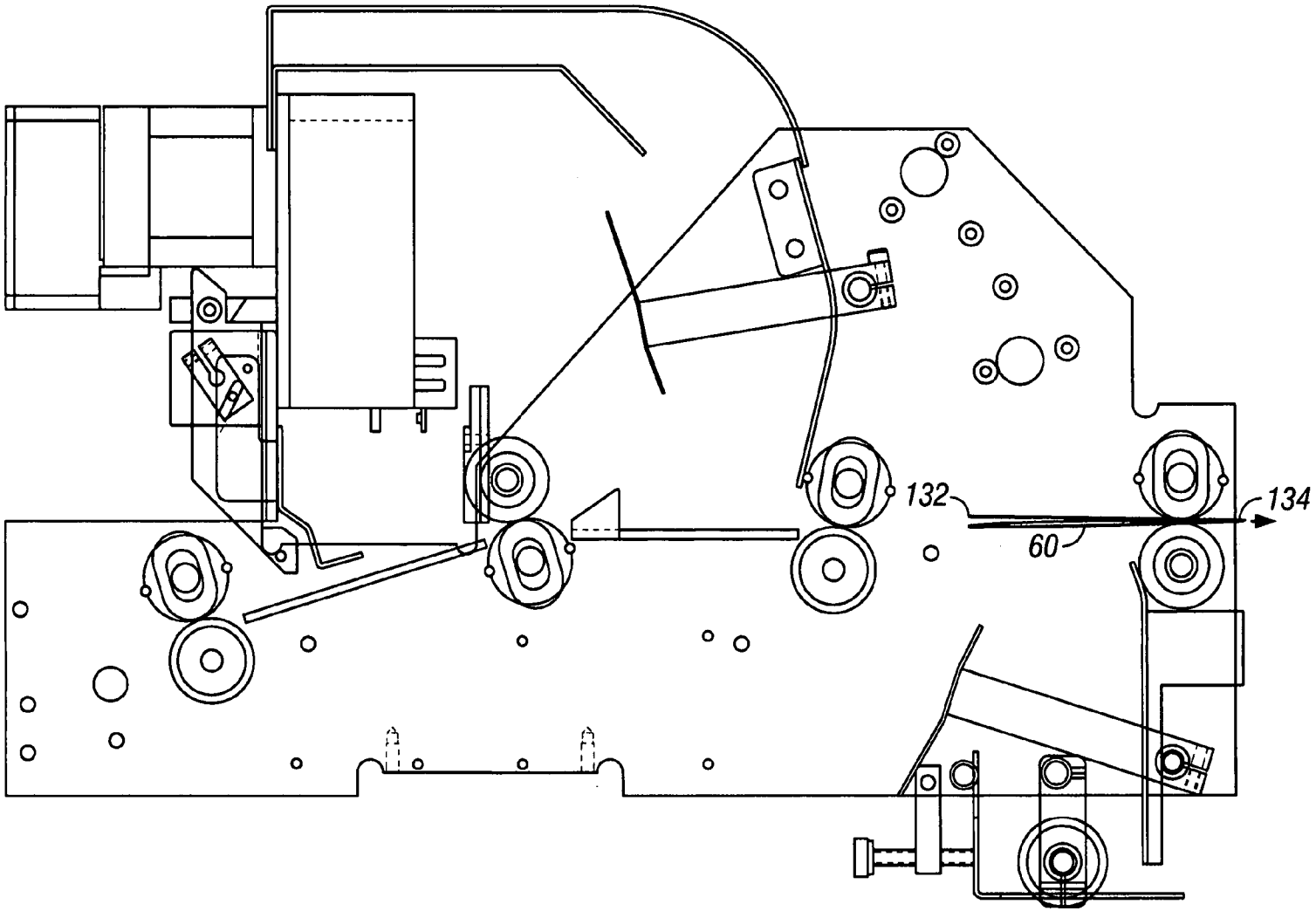
FIG. 22 is another side view of the carrier folding path showing the fifth step in folding a carrier into a C-fold configuration.

The second folding station includes another pivotally mounted folding arm 116 with another pusher member 117 and another pair of folding pinch rollers 118. When the partly folded carrier is driven forwardly by the rollers 114, the folded edge 115, it passes of over the top of the other pusher member 117 and falls behind it into a folding well 122 defined by a vertically aligned blocking wall 123 that guides the edge 115 downwardly to an underlying edge support member 124. The rear section remains held by the rollers 114 as shown in FIG. 15. Then the other folding arm 116 is moved from the home position as shown in FIG. 15 to a fold position as shown in FIG. 16 to push the middle of the unfolded portion of the carrier 33 into the nib of the folding rollers 118. At approximately the same time, a pivotal holding member 120 is pivoted from a non-holding position, as shown in FIGS. 14 and 15, to a holding position, as shown in FIG. 16 in which a roller 121 at a distal end of the holding member 120 presses the folded portion of carrier 33 against the vertical wall 123 to hold the carrier 33 in place, as shown in FIG. 16, while the pusher member makes the partial second fold in the carrier 33. The rollers 118 then grip the partly folded carrier 33 and passes it out through the rollers 118 to complete the second fold. The now folded and completed package 60 is then passed to the package stacker 64. The roller 121 permits the carrier adjacent the folded edge 115 of the carrier 33 to be pulled out of the well 122 while still being pressed against the vertical wall 123. The folding arm 116 then returns to a home position, as shown in FIG. 17. It should be appreciated that before folding the cards are attached to the carrier 33 but have not been shown in FIGS. 13–17 and subsequent like drawing figures for purposes of clarity of view Referring now to FIGS. 18–22, the operation of the folding apparatus when being used to fold carriers into a C-fold configuration is shown. First, as shown in FIG. 18 the carrier is passed through the rollers 86 until a location approximately one third of carrier length is located opposite and beneath the pusher member 108 in its home position as shown. The leading edge 132 of the carrier is pushed around the arcuate guide 104, and over the rollers 86, but a carrier support member 130 provides underlying support to prevent the carrier from drooping downwardly too far. Then, as shown in FIG. 19, the folding arm 160 is pivoted to the fold position to partly form the first fold at a location one-third the length from the lagging end 134. The pusher member 108 pushes the carrier into the nib of the rollers 114 and the rollers pull the carrier through the rollers to complete the first fold. The folded edge of the carrier 33 falls over and behind the pusher member 108 and into the well 122 as shown in FIG. 20 with the original leading edge still being held by the rollers 114. Next, as seen in FIG. 21, the roller 121 is pressed against the side of the carrier in the well 122, and the pusher member is pivoted to the fold position to form a preliminary fold in the carrier approximately one third of the length from the original leading 132 that is pushed into the nib of the folding rollers 118. Then, as seen in FIG. 22, the completely folded carrier is pulled through the rollers 118 and out of the well 122 and out to the stacker 64.

Figure 23:
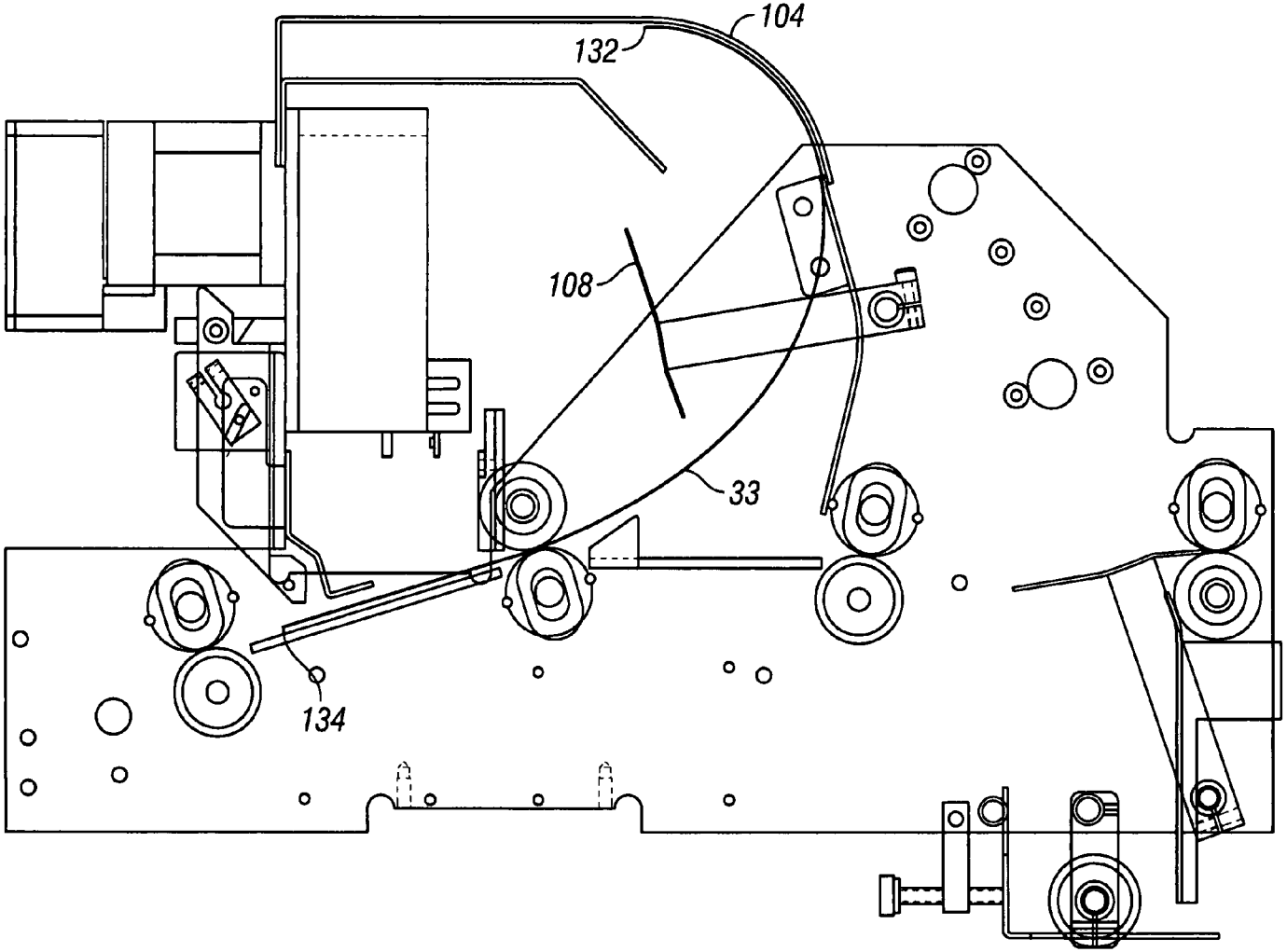
FIG. 23 is another side view of the carrier folding path showing the first step in folding a carrier into a bi-fold, or half fold, configuration.
Figure 24:
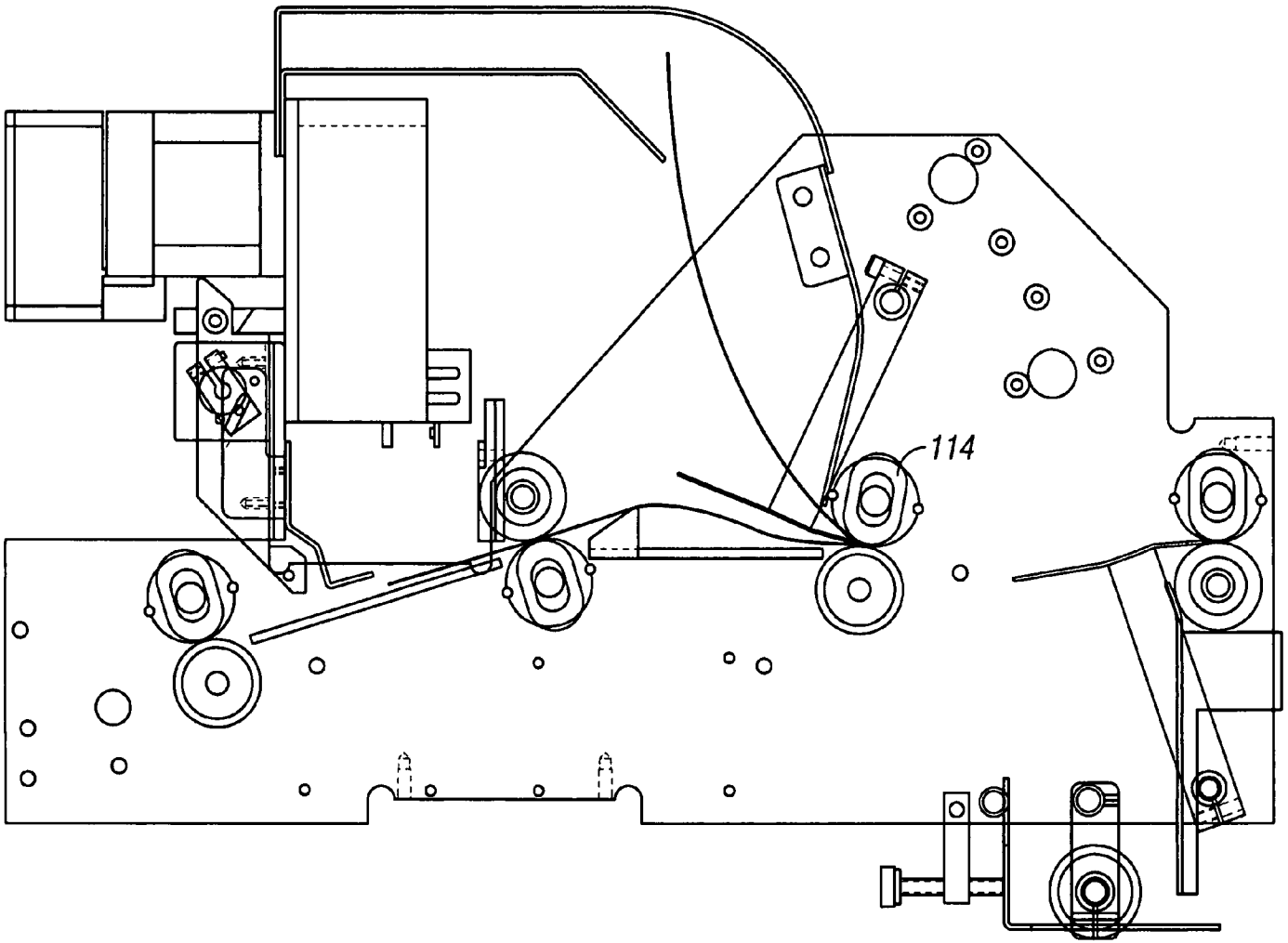
FIG. 24 is another side view of the carrier folding path showing the second step in folding a carrier into a bi-fold, or half fold, configuration.
Figure 25:
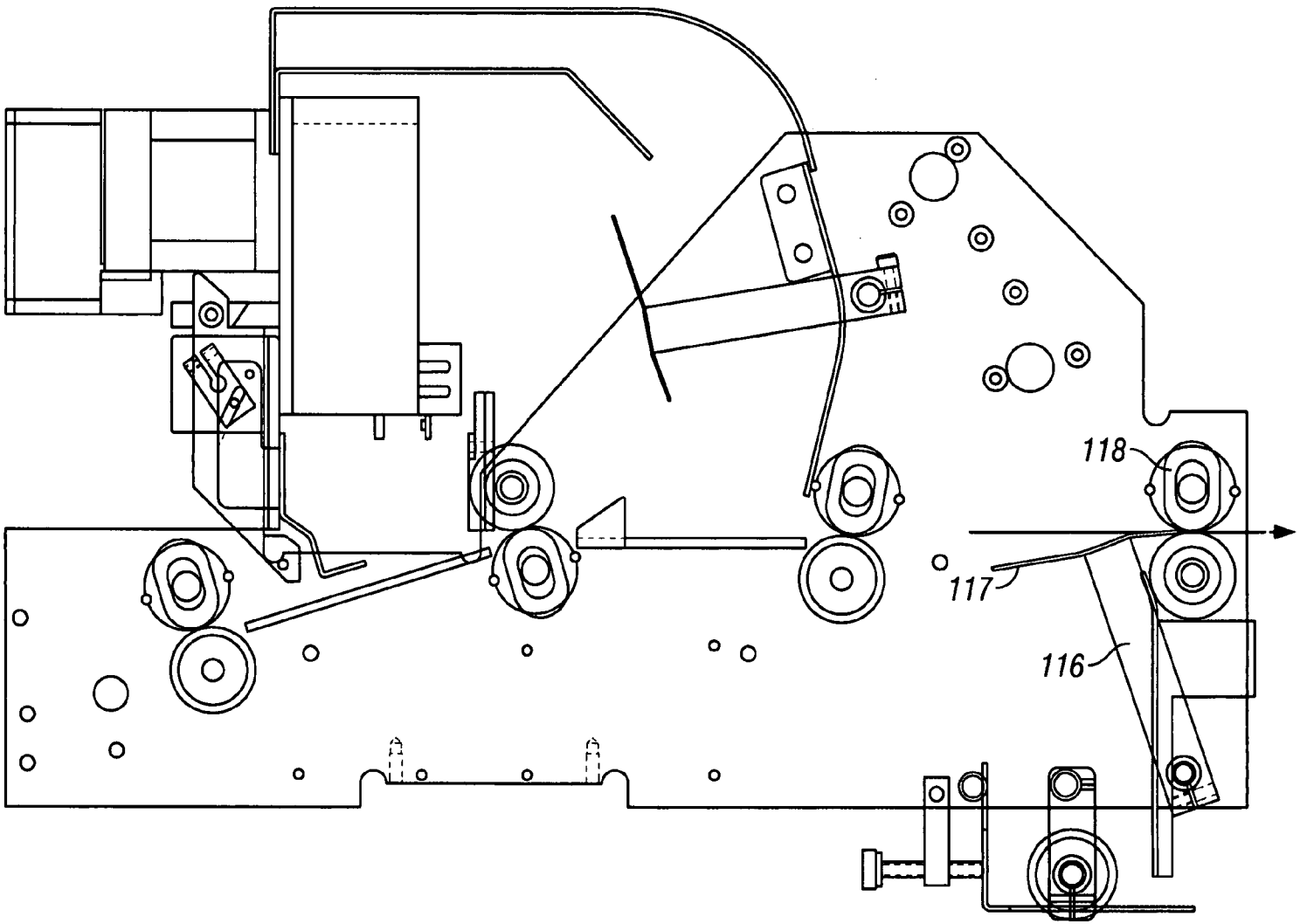
FIG. 25 is another side view of the carrier folding path showing the second step in folding a carrier into a bi-fold, or half fold, configuration.

Referring now to FIGS. 23–25, the operation of the folding apparatus when used to form a card package 60 in a bi-fold, or half fold, or half-fold configuration is illustrated. First the carrier is driven by the rollers 80 and 82 beneath the pusher member 108 in its home position into and around the arcuate guide until a midpoint is located opposite the pusher member 108. Next, as seen in FIG. 24, the pusher member is pivoted into the halfway point on the carrier 33 to form a partial fold that is then pushed into the nib of the rollers. The folding rollers 114 then complete the fold and pull the carrier 33, folded edge first, to the other side of the rollers 114. As seen in FIG. 25, folding arm 116 and pusher member 117 are placed in the home position and kept in the home position. Accordingly, when the folded edge of the half-folded carrier package 60 arrives on the exit side of the rollers 114, the pusher member 117 acts as an underlying guide and support to keep the carrier from falling into the folding well 122. Instead, the folded carrier 133 passes over the top of the pusher member and into the nib of the folding rollers 118. The folding rollers 118 then simply pass the half-folded form through to the package stacker 64 without imparting any further folds.

Figure 26:
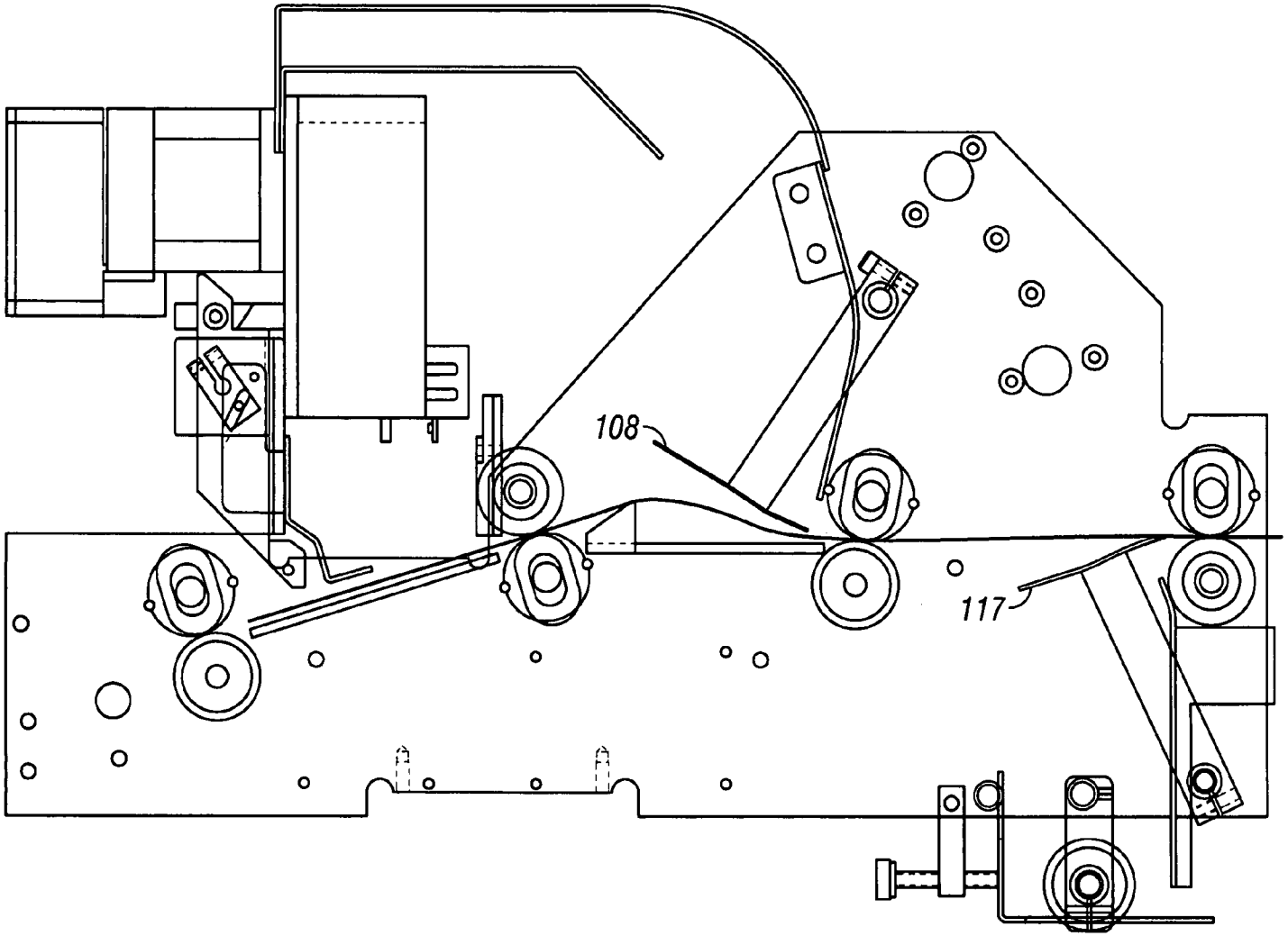
FIG. 26 is a another side view of the carrier folding path showing the configuration of producing a carrier package in a no-fold configuration.

Referring to FIG. 26, when the folding apparatus is used to prepare card packages 60 that are in a no-fold configuration, both of the carrier pusher 108 is moved to a an overlying guide position above the carrier 33 as it is fed through the rollers 80 and 86 to guide the leading edge downwardly into the nib of the folding rollers 114. The other carrier pusher member is also located in an intermediate bridging position as shown in which the leading edge of the carrier is prevented from falling into the well 122 and instead is supported and guided into the nib of the rollers 118. The rollers then simply pass the unfolded card package 60 to the stacker.

In all modes of operation, suitable motors are used to drive the various rollers and to move the carrier pusher members 108 and 117 to the appropriate position. Likewise, position sensors may be used to sense when the pusher members are in the home position and when in the fold position. The particular timing of the sequence of steps depends upon the speed at which it is desired to operate the mailing system 30. Home and fold position sensors prevent carrier movement when the pusher members are not in the correct position for the operation to be performed. The different sequence of steps noted above for the different modes of operation are stored in the computer controller 42 and are selected though use of the keyboard 46 and display 44.

Figure 27:
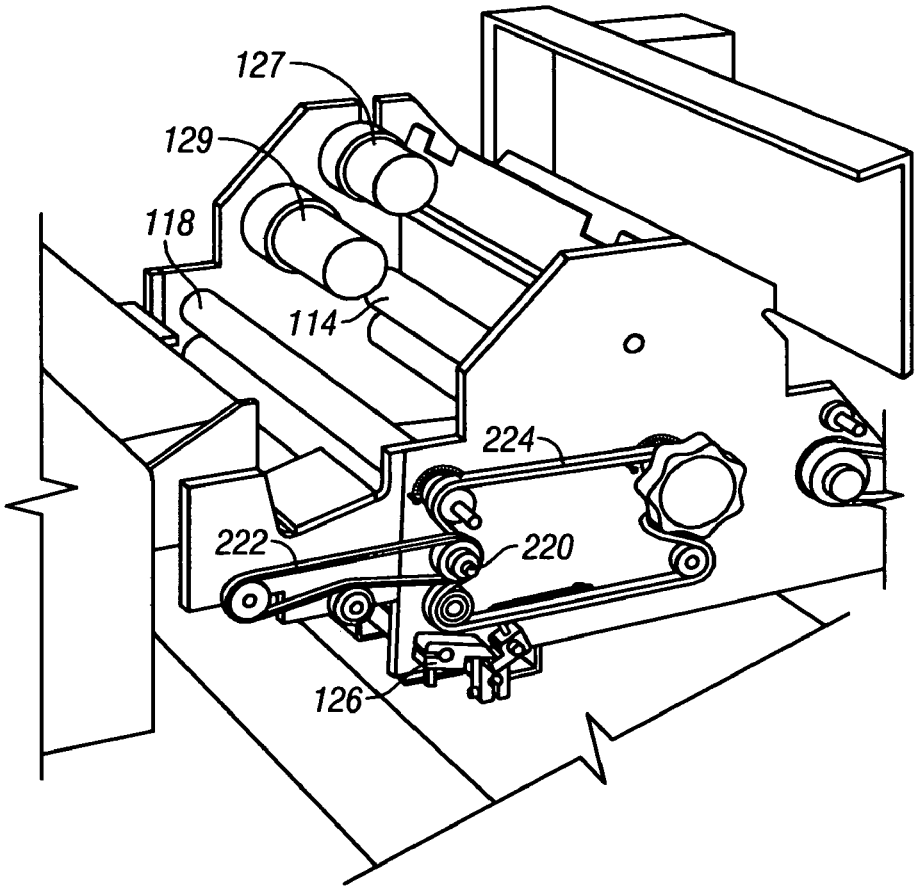
FIG. 27 is a perspective view of a portion of the card mailer illustrating the linkages of drives with the rollers and folding arms.
Figure 28:
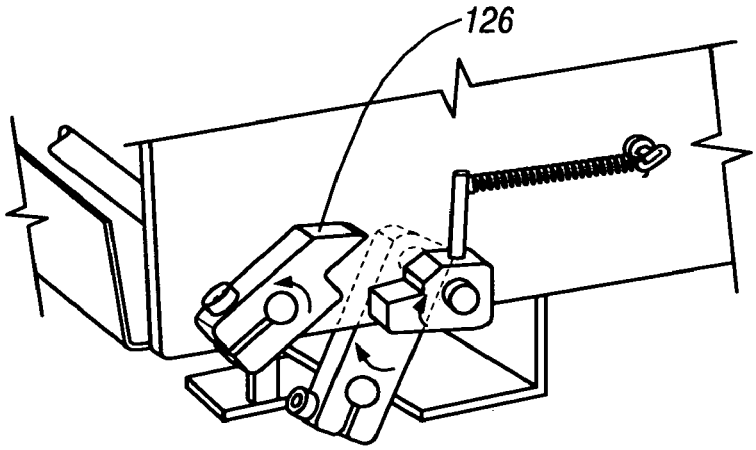
FIG. 28 is an enlarged perspective view of a portion of FIG. 27

Referring to FIG. 27, the stepper drive motor 113 of FIG. 7 is connected to a drive shaft 220 with a pulley wheel that drives a pair of belts 222 and 224. Belt 224 links all of the drive shafts of the pinch rollers 118 and 114. A linkage 126, better seen in FIG. 28, is linked to the movement of the second pivot arm to move into engagement when the arm moves to the fold position and to return to its home position when the arm returns to the home position.

While a particular embodiment has been shown and described in detail, it should be appreciated that many variation may be made without departing from the spirit and scope of the invention as defined in the appended claims.

The invention claimed is:

1. In a card mailing system for producing card packages formed of a card attached to a matching card carrier form having means for attaching cards to matching carriers, the improvement being a carrier folding apparatus, comprising:

means for folding carriers at a plurality of folding stations spaced along a carrier path at which folds to the carriers are made;

means for selectively passing the carriers to the plurality of folding stations to selectively fold the carriers into a plurality of different fold configurations including a plurality of feed rollers to feed the carriers to the plurality of folding stations, and means for selectively changing the amount of a carrier that is fed to a folding station by at least one of the plurality of feed rollers to obtain different fold configurations.

a movably mounted folding arm at each of the plurality of folding stations, and means for selectively and independently moving each folding arms between a home position and a fold position, movement of an arm to a fold position engaging the carrier at a location of the carrier to create a fold in the carrier at said location.

2. The card mailing system of claim 1 in which movement of the fold arm to the fold position pushes the location of engagement of the carrier into a nib of a pair of pinch rollers, and the fold is created at the location by passing the part of the carrier through the pair of pinch rollers.

3. In a card mailing system for producing card packages formed of a card attached to a matching card carrier form having means for attaching cards to matching carriers, the improvement being a carrier folding apparatus, comprising:

means for folding carriers at a plurality of folding stations spaced along a carrier path at which folds in the carriers are made;

means for selectively passing the carriers to the plurality of folding stations to selectively fold the carriers into a plurality of different fold configurations including a plurality of feed rollers to feed the carriers to the different folding stations, and means for selectively changing the amount of a carrier that is fed to a fold position to obtain different fold configurations, a movably mounted folding arm at each of the plurality of folding stations, and means for selectively and independently moving each of the folding arms between a home position and a fold position, movement of an arm to a fold position engaging the carrier to create a fold in the carrier, and movement of the fold arm to the fold position moving a part of the carrier into a nib of a pair of pinch rollers with the fold being created by passing the part of the carrier through the pair of pinch rollers; and a control system with sensors for sensing the location of the carriers relative to the different folding stations; and means responsive to the sensors for selectively moving the folding arms.

4. In a card mailing system for producing card packages formed of a card attached to a matching card carrier form having means for attaching cards to matching carriers, the improvement being a carrier folding apparatus, comprising:

means for folding carriers at a plurality of folding stations spaced along a carrier path at which folds to the carriers are made;

means for selectively passing the carriers to the plurality of folding stations to selectively fold the carriers into a plurality of different fold configurations including a plurality of feed rollers to feed the carriers to the different folding stations, and means for selectively changing the amount of a carriers that is fed to a folding station to obtain different fold configurations, a movably mounted folding arm at each of the plurality of folding stations, and means for selectively and independently moving each of the folding arms between a home position and a fold position, movement of an arm to a fold position engaging the carrier to create a fold in the carrier, and in which a first one of the plurality of folding stations at which a first fold is made to the carriers includes a folding arm, and a guide for engaging a leading edge and bottom surface of a carrier to guide a front section of the carrier into an upwardly curved configuration with a fold location beneath the folding arm and the leading edge above the arm and pressed forwardly against the guide.

5. The card mailing system of claim 4 including a pair of folding pinch rollers located forwardly of the carrier and beneath the folding arm, and means for pivotally moving the folding arm against a top surface of the carrier opposite the bottom surface to push the bottom surface of the carrier at the first fold location into a nib of the first pair of folding pinch rollers.

6. The card mailing system of claim 4 including a pair of feed pinch rollers for feeding the carriers to the first folding station and into the guide and including means for selectively controlling the pair of pinch rollers to change the location of the carrier relative to the first food pinch rollers and the first folding arm when the first folding arm pushes the carrier into the nib to selectively change the location of the fold relative to the ends of the leading edge of the carrier.

7. The card mailing system of claim 6 in which the selectively controlling means controls the pair of feed pinch rollers to locate the fold line at a location approximately one third of the length of the carrier from the leading edge to make the first fold of a carrier to be folded in a Z-fold configuration.

8. The card mailing system of claim 6 in which the selectively controlling means controls the pair of feed pinch rollers to locate the fold line at a location approximately two third the length of the carrier from the leading edge to make the first fold of a carrier to be folded in a C-fold configuration.

9. The card mailing system of claim 6 in which the selectively controlling means controls the pair of feed pinch rollers to locate the fold line at a location approximately one half the length of the carrier from the leading edge to make the fold of a carrier to be folded in a bi-fold configuration.

10. The card mailing system of claim 4 in which the first folding station includes a first fold arm, a first set of folding pinch rollers, and means for selectively controlling the first fold arm to position the arm in a location that diverts the leading edge of the carrier away from the guide and into the first set of folding pinch rollers to avoid folding a carrier that is to have a no-fold configuration.

11. The card mailing system of claim 10 including a second folding station with a second set of folding pinch rollers, a second fold arm, and means for selectively controlling the second fold arm to position the arm in a location that diverts the leading edge of the carrier to the second set of folding pinch rollers to pass a carrier with a no-fold configuration to a carrier package outlet.

12. In a card mailing system for producing card packages formed of a card attached to a matching card carrier form having means for attaching cards to matching carriers, the improvement being a carrier folding apparatus, comprising:

means for folding carriers at a plurality of folding stations spaced along a carrier path at which folds to the carriers are made in which a first one of the plurality of folding stations at which a first fold is made to the carriers includes a folding arm, and a guide for engaging a leading edge and bottom surface of a carrier to guide a front section of the carrier into an upwardly curved configuration with a fold location beneath the folding arm and the leading edge above the arm and pressed forwardly against the guide, a pair of folding pinch rollers located forwardly of the carrier and beneath the folding arm, and means for pivotally moving the folding arm against a top surface of the carrier opposite the bottom surface to push the bottom surface of the carrier at the first fold location into a nib of the first pair of folding pinch roller; and means for selectively passing the carriers to the plurality of folding stations to selectively fold the carriers into a plurality of different fold configurations and in which the folded carrier is moved through the first folding pinch rollers and allowed to droop downwardly into a second folding station at which the folded edge is supported against an L-shaped, carrier edge support member and while the lagging edge of the carrier is still being supported by the first folding rollers with an intermediate section of the card in overlying relationship with respect to a second folding arm.

13. The card mailing system of claim 12 including means for pivotally moving the second folding arm upwardly and forwardly to push the unfolded portion of the carrier into a nib of a second folding rollers at a second fold line, said second folding rollers feeding the carrier through the rollers to make a second fold and to pass the carrier to a card package outlet.

14. In a card mailing system for producing card packages formed of a card attached to a matching card carrier form having means for attaching cards to matching carriers, the improvement being a carrier folding apparatus, comprising:

means for folding carriers at a plurality of folding stations spaced along a carrier path at which folds to the carriers are made including a first one of the plurality of folding stations at which a first fold is made to the carriers having a folding arm and a guide for engaging a leading edge and bottom surface of a carrier to guide a front section of the carrier into an upwardly curved configuration with a fold location beneath the folding arm and the leading edge above the arm and pressed forwardly against the guide, and a second station including a second fold arm and means for selectively controlling the second fold arm to position the arm in a location that diverts the lead folded edge of a bi-fold carrier to the second folding rollers; and means for selectively passing the carriers to the plurality of folding stations to selectively fold the carriers into a plurality of different fold configurations.

15. In a card mailing system for producing card packages formed of a card attached to a matching card carrier form having means for attaching cards to matching carriers, the improvement being a carrier folding apparatus, comprising:

means for folding carriers at a plurality of folding stations spaced along a carrier path at which folds to the carriers are made;

means for selectively passing the carriers to the plurality of folding stations to selectively fold the carriers into a plurality of different fold configurations, and in which a first one of the plurality of folding station includes a first pair of folding pinch rollers and a folding arm, and including a second folding station for making a second fold for Z-fold and C-fold carriers with a second set of folding pinch rollers located forwardly of the carrier and beneath the folding arm, and means for pivotally moving the folding arm against a top surface of the carrier opposite the bottom surface to push the bottom surface of the carrier at the first fold location into a nib of the first pair of folding pinch rollers.

16. In a card mailing system for producing card packages formed of a card attached to a matching card carrier form having means for attaching cards to matching carriers, the improvement being a carrier folding apparatus, comprising:

means for folding carriers at a plurality of folding stations spaced along a carrier path at which folds to the carriers are made including a first one of the plurality of folding station having a first pair of folding pinch rollers and a folding arm, and a second folding station for making a second fold for Z-fold and C-fold carriers with a second set of folding pinch rollers located forwardly of the carrier and beneath the folding arm;

means for pivotally moving the folding arm against a top surface of the carrier opposite the bottom surface to push the bottom surface of the carrier at the first fold location into a nib of the first pair of folding pinch rollers;

means for selectively passing the carriers to the plurality of folding stations to selectively fold the carriers into a plurality of different fold configurations, the folded carrier being moved through the first folding pinch rollers and allowed to droop downwardly until the folded edge is supported against an L-shaped, carrier edge support with a upstanding wall and an underlying support ledge while the lagging edge of the carrier is still being supported by the first folding pinch rollers with an intermediate section of the card in overlying relationship with respect to a second folding arm; and a selectively movably mounted member for pressing the carrier against the upstanding wall after the folded edge engages the support ledge and before the fold is made.

17. In a card mailing system for producing card packages formed of a card attached to a matching card carrier form having means for attaching cards to matching carriers, a method of folding carriers, comprising the steps of:

folding carriers at a plurality of folding stations spaced along a carrier path at which folds to the carriers are made;

selectively passing the carriers to the plurality of folding stations to selectively fold the carriers into a plurality of different fold configurations by rotating a plurality of rollers to feed the carriers to the different folding stations;

selectively changing the amount of a carrier that is fed by the rollers to a folding stations to obtain different fold positions; and selectively independently moving a folding arm to push a carrier into a nib of a pair of rollers to form a fold.

18. The method of claim 17 including the steps of selectively controlling a pair of feed rollers to locate a fold line at a location approximately one third of the length of the carrier from the leading edge to make a first fold of a carrier to be folded in a Z-fold configuration.

19. The method of claim 17 including the steps of selectively controlling a pair of feed rollers to locate a fold line at a location approximately two third length of the carrier from a leading edge to make the first fold of a carrier to be folded in a C-fold configuration.

20. The method of claim 17 including the steps of selectively controlling a pair of feed rollers to locate a fold line at a location approximately one half a length of the carrier from a leading edge to make the fold of a carrier to be folded in a bi-fold configuration.

21. The method of claim 17 including the steps of selectively controlling a first fold arm to position the arm in a location that diverts a leading edge of the carrier away from the guide and into a first set of folding rollers to avoid folding a carrier that is to have a no-fold configuration.

22. The method of claim 21 including the steps of selectively controlling a second fold arm to position the second arm in a location that diverts the leading edge of the carrier to the second set of folding pinch rollers to pass a carrier with a no-fold configuration to a carrier package outlet.

23. In a card mailing system for producing card packages formed of a card attached to a matching card carrier form having means for attaching cards to matching carriers, a method of folding carriers, comprising the steps of:

folding carrier at a plurality of folding stations spaced along a carrier path at which folds to the carriers are made;

selectively passing the carriers to the plurality of folding stations to selectively fold the carriers into a plurality of different fold configurations by rotating a plurality of rollers to feed the carriers to the different fold positions;

selectively changing the amount of a carrier that is fed to a fold position to obtain different fold positions;

selectively independently moving a folding arm to push a carrier into a nib of a pair of rollers to form a fold; and guiding the carriers with an arcuate guide that engages a leading edge and bottom surface of a carrier to guide a front section of the carrier into an upwardly curved configuration with a fold location beneath a folding arm and the leading edge above the arm and pressed forwardly against the guide.

24. In a card mailing system for producing card packages formed of a card attached to a matching card carrier form having means for attaching cards to matching carriers, a method of folding carriers, comprising the steps of:

folding carriers at a plurality of folding stations spaced along a carrier path at which folds to the carriers are made;

selectively passing the carriers to the plurality of folding stations to selectively fold the carriers into a plurality of different fold configurations including the steps of moving a carrier through a first pair of folding pinch rollers and allowing the carrier to droop downwardly into a second folding station at which a folded edge is received within a well and supported against an L-shaped, carrier edge support member while a lagging edge of the carrier is still being supported by the first pair of folding pinch rollers with an intermediate section of the carrier in overlying relationship with respect to a second folding arm.

25. The method of claim 24 including the step of pivotally moving a second folding arm upwardly and forwardly to push an unfolded portion of a carrier into a nib of the second folding rollers at a second fold line, said second folding rollers feeding the carrier through the rollers to make the second fold and to pass the carrier to a card package outlet.

26. In a card mailing system for producing card packages formed of a card attached to a matching card carrier form having means for attaching cards to matching carriers, a method of folding carriers, comprising the steps of:

folding carriers at a plurality folding stations spaced along a carrier path at which folds to the carriers are made;

selectively passing the carriers to the plurality of folding stations to selectively fold the carriers into a plurality of different fold configurations by rotating a plurality of rollers to feed the carriers to the different fold positions;

selectively changing the amount of a carrier that is fed to a fold position to obtain different fold positions;

selectively independently moving a folding arm to push a carrier into a nib of a pair of rollers to form a fold;

feeding the carriers to a first fold station with a pair of feed pinch rollers and into engagement with a guide; and selectively controlling the pair of pinch rollers to change the location of the carrier relative to the first folding pinch rollers and a first folding arm when the folding arm pushes the carrier into the nib to selectively change the location of the fold relative to opposite ends of the leading edge of the carrier.

27. In a card mailing system for producing card packages formed of a card attached to a matching card carrier form having means for attaching cards to matching carriers, a method of folding carriers, comprising the steps of:

folding carriers at a plurality of folding stations spaced along a carrier path at which folds to the carriers are made;

selectively passing the carriers to the plurality of folding stations to selectively fold the carriers into a plurality of different fold configurations by rotating a plurality of rollers to feed the carriers to the different fold positions;

selectively changing the amount of a carrier that is fed to a fold position to obtain different fold positions;

selectively independently moving a folding arm to push a carrier into a nib of a pair of rollers to form a fold; and selectively controlling a second fold arm to position the arm in a location that diverts a lead folded edge of a bi-fold carrier to a second pair of folding rollers.

28. In a card mailing system for producing card packages formed of a card attached to a matching card carrier form having means for attaching cards to matching carriers, a method of folding carriers, comprising the steps of:

folding carriers at a plurality of folding stations spaced along a carrier path at which folds to the carriers are made;

selectively passing the carriers to the plurality of folding stations to selectively fold the carriers into a plurality of different fold configurations by rotating a plurality of rollers to feed the carriers to the different fold positions;

selectively changing the amount of a carrier that is fed to a fold position to obtain different fold positions;

selectively independently moving folding arm to push a carrier into a nib of a first pair of rollers to form a fold;

making a second fold for Z-fold and C-fold carriers with a second set of folding pinch rollers located forwardly of the carrier and beneath a folding arm; and pivotally moving the folding arm against a top surface of the carrier opposite bottom surface to push the bottom surface of the carrier at the first fold location into a nib of the first pair of folding pinch rollers.

29. In a card mailing system for producing card packages formed of a card attached to a matching card carrier form having means for attaching cards to matching carriers, a method of folding carriers, comprising the steps of:

folding carriers at a plurality of folding stations spaced along a carrier path at which folds to the carriers are made and in which the folded carrier is moved through a first set of folding pinch rollers and allowed to droop downwardly until the folded edge is supported against an L-shaped, carrier edge support with a upstanding wall and an underlying support ledge while the lagging edge of the carrier is still being supported by a first set of folding rollers with an intermediate section of the card in overlying relationship with respect to a second folding arm, and including the step of selectively pressing, with the movable mounted member, the carrier against the upstanding wall after the folded edge engages the support ledge and before the fold is made; and selectively passing the carriers to the plurality or folding locations to selectively fold the carriers into a plurality of different fold configurations.

* * * * *